US006892666B1

(12) United States Patent
Plante et al.

(10) Patent No.: US 6,892,666 B1
(45) Date of Patent: May 17, 2005

(54) WATERCRAFT SUSPENSION

(75) Inventors: Renald Plante, Rock-Forest (CA); Yves Berthiaume, Mont St-Hilaire (CA)

(73) Assignee: Bombardier Recreational Products Inc., Valcourt (CA)

( * ) Notice: Subject to any disclaimer, the term of this patent is extended or adjusted under 35 U.S.C. 154(b) by 0 days.

(21) Appl. No.: 10/370,573

(22) Filed: Feb. 24, 2003

Related U.S. Application Data

(60) Provisional application No. 60/358,355, filed on Feb. 22, 2002.

(51) Int. Cl.[7] ..... B63B 17/00; B63H 23/00

(52) U.S. Cl. ..... 114/363; 114/55.57; 114/364; 440/75; 440/83

(58) Field of Search ..... 114/55.5, 55.54, 114/55.55, 55.56, 55.57, 343, 363, 364; 440/38, 440/53, 63, 83, 111, 112; 464/50, 172, 173

(56) References Cited

U.S. PATENT DOCUMENTS 2,617,377 A * 11/1952 Evans ..... 114/191
3,158,129 A * 11/1964 Horst ..... 114/55.55
3,528,380 A * 9/1970 Yost ..... 114/283
3,948,206 A 4/1976 Tyler
3,987,743 A * 10/1976 Pensel ..... 114/283
3,998,176 A * 12/1976 Stout et al. ..... 114/283
4,101,997 A 7/1978 Tyler
5,376,028 A * 12/1994 Koyanagi ..... 440/41
5,542,371 A * 8/1996 Harvey et al. ..... 114/363
5,603,281 A * 2/1997 Harvey et al. ..... 114/363
6,019,054 A 2/2000 Hattori et al.
6,152,062 A 11/2000 Hattori
6,786,172 B1 * 9/2004 Loffler ..... 114/363

OTHER PUBLICATIONS

Wrenchbender, The Personal Watercraft Phenomenon, pgs. 1 of 4, Feb. 4, 2002.
Sea-Doo Parts Catalog, HX 5881, Mar. 1996.
Sea-Doo Parts Catalog, XP Limited 5665, 5667, 1998.
On Deck Watercrafts, pp. 1 of 3, Feb. 4, 2002.

* cited by examiner

*Primary Examiner*—S. Joseph Morano
*Assistant Examiner*—Ajay Vasudeva
(74) *Attorney, Agent, or Firm*—BRP Legal Services

(57) ABSTRACT

A watercraft has a pivoting, shock absorbing component that absorbs forces applied to its hull. The watercraft includes a hull, a deck coupled to the hull, an engine, and a jet propulsion system movably coupled to the engine. In one embodiment, a forward hull portion couples to the deck and a rearward hull portion movably couples to the deck and/or the forward hull portion. The jet propulsion system mounts to the rearward hull portion, while the engine mounts to the deck. A suspension element is disposed between the hull rear portion and either the deck or the hull forward portion. In another embodiment, the hull and deck are movably coupled to each other.

12 Claims, 17 Drawing Sheets

WATERCRAFT SUSPENSION

CROSS-REFERENCE

This application claims the benefit of priority to U.S. Provisional Patent Application No. 60/358,355 titled "WATERCRAFT SUSPENSION," filed on Feb. 22, 2002, which is incorporated herein by reference.

BACKGROUND OF THE INVENTION

1. Field of the Invention

This invention relates to jet powered watercraft, especially personal watercraft ("PWC"). More specifically, the invention concerns suspension systems that assist the performance of the watercraft.

2. Description of Related Art

Jet powered watercraft have become very popular in recent years for recreational use and for use as transportation in coastal communities. The jet power offers high performance, which improves acceleration, handling and shallow water operation. Accordingly, PWCs, which typically employ jet propulsion, have become common place, especially in resort areas.

As use of PWCs has increased, the desire for better performance and enhanced maneuverability has become strong. Operators need to be able to handle the watercraft in heavily populated areas, especially to avoid obstacles, other watercraft and swimmers. Also, more people use PWCs as a mode of transportation, it is also preferred that the craft be easily docked and maneuvered in public places.

Typically, jet powered watercraft have a jet pump mounted within the hull that takes in water and expels the water at a high thrust to propel the watercraft. Most PWCs operate with this system. To control the direction of the watercraft, a nozzle is generally provided at the outlet of the jet pump to direct the flow of water in a desired direction. In the conventional PWC, turning is achieved by redirecting the flow of water from the nozzle.

The nozzle is mounted on the rear of the craft and pivots such that the flow of water may be selectively directed toward the port and starboard sides within a predetermined range of motion. The direction of the nozzle is controlled from the helm of the watercraft by the person operating the craft. By this, the operator can steer the watercraft in a desired direction. For example, when a PWC operator chooses to make a starboard-side turn, he or she turns the helm clockwise. This causes the nozzle to be directed to the starboard side of the PWC so that the flow of water will effect a starboard turn.

When the watercraft travels over very choppy water, the jet propulsion system may become disengaged from the water. When this occurs, there is an interruption of jet flow of water, and hence, a decrease in the propulsion power or thrust provided by the jet propulsion system. As a result, a need has developed to minimize the likelihood that the jet propulsion system will become disengaged from the water when the watercraft is traveling over very choppy water.

For at least these reasons, a need has developed for a watercraft which provides uninterrupted jet flow of water to the jet propulsion system when the watercraft is travelling in wavy or choppy water.

SUMMARY OF THE INVENTION

Therefore, one aspect of embodiments of this invention provides a watercraft suspension system that minimizes the likelihood that the jet propulsion system can become disengaged from the water.

Another aspect of embodiments of the present invention provides a watercraft with a jet propulsion system which is movably coupled to the watercraft.

Another aspect of embodiments of the present invention provides a watercraft with a hull or hull portion which is movably coupled to the deck of the watercraft.

An additional aspect of embodiments of the present invention provides a suspension system through which the hull or hull portion is coupled to the deck.

An additional aspect of embodiments of the present invention provides a watercraft having a suspension system and a minimum of unsprung weight.

An additional aspect of embodiments of the present invention provides a watercraft that includes a relatively high inertia portion that is coupled to a relatively low inertia portion. The watercraft's engine is mounted to the high inertia portion while the jet propulsion system is mounted to the low inertia portion.

An additional aspect of embodiments of the present invention provides a jet propulsion system which is movably coupled to the engine of the watercraft.

A further aspect of embodiments of the present invention provides a high degree of maneuverability and comfort to the watercraft by providing the bow of the watercraft with skis coupled to the hull through a suspension element.

Specifically, one or more embodiments of this invention are directed to a watercraft having a hull, a deck coupled to the hull, an engine disposed within the watercraft, and a jet propulsion system. The jet propulsion system includes an impeller and is coupled to the engine so that the jet propulsion system can pivot with respect to the engine.

According to one or more of these embodiments, the watercraft also has an articulated drive shaft operatively connecting the engine to the jet propulsion system. The drive shaft has a first drive shaft section coupled to the engine, a second drive shaft section coupled to the jet propulsion system, and an articulating coupling that couples the first and second drive shaft sections.

According to one or more of these embodiments, the watercraft also has a suspension element disposed between the deck and the hull.

One or more embodiments of this invention are directed to a watercraft having a deck, a hull having a forward portion coupled to the deck and a rearward portion movably coupled to one of the deck and the forward portion, an engine disposed within the watercraft, a propulsion system operatively coupled to the engine, the propulsion system being coupled to the hull rear portion, and a suspension element disposed between the hull rear portion and one of the deck and the forward portion.

According to one or more of these embodiments, the watercraft also has an engine compartment disposed between the forward portion and the deck such that the engine is disposed within the engine compartment.

According to one or more of these embodiments, the suspension element is disposed between the rearward portion of the hull and a rearward portion of the deck.

According to one or more of these embodiments, the watercraft also has a pivot assembly through which the rearward portion is coupled to one of the deck and the hull forward portion.

One or more embodiments of this invention are directed to a watercraft having a deck, a hull moveably coupled to the deck, an engine substantially immovably coupled to the deck, a jet propulsion system operatively coupled to the engine, the jet propulsion system being coupled to the hull, and a suspension element disposed between the deck and the hull.

According to one or more of these embodiments, the suspension element is disposed between a rearward portion of the hull and a rearward portion of the deck.

According to one or more of these embodiments, the forward portion of the hull is pivotally coupled to a forward portion of the deck.

According to one or more of these embodiments, the suspension element is disposed between a forward portion of the hull and a forward portion of the deck.

According to one or more of these embodiments, the suspension element includes a first suspension element, which is disposed between a rearward portion of the hull and a rearward portion of the deck, and the watercraft further includes a second suspension element disposed between a forward portion of the hull and a forward portion of the deck. The second suspension element may include a flexible beam coupled to the forward portion of the hull and the forward portion of the deck. The first suspension element may include a swing arm having first and second spaced pivot points, the first pivot point being pivotally connected to the rearward portion of the hull, the second pivot point being pivotally connected to the rearward portion of the deck, and a first shock absorber extending between the swing arm and the deck.

According to one or more of these embodiments, the watercraft also has an internal frame coupled to the deck at a position beneath the deck. The engine is supported by the internal frame.

Preferably, the watercraft is a personal watercraft (PWC). The PWC can be a straddle type seated PWC or a stand-up PWC. Additionally, the watercraft could be different types of jet powered watercraft, such as a jet boat, or even a watercraft powered by a conventional propeller driven system.

These and/or other aspects of embodiments of this invention will become apparent upon reading the following disclosure in accordance with the Figures.

BRIEF DESCRIPTION OF THE DRAWINGS

An understanding of the various embodiments of the invention may be gained by virtue of the following figures, of which like elements in various figures will have common reference numbers, and wherein.

DETAILED DESCRIPTION OF PREFERRED EMBODIMENTS

The invention is described with reference to a PWC for purposes of illustration only. However, it is to be understood that the suspension systems described herein can be utilized in any watercraft, particularly those crafts that are powered by a jet propulsion system, such as sport boats.

The general construction of a watercraft 10 in accordance with a first preferred embodiment of this invention is shown in FIGS. 1–5. The following description relates to one way of manufacturing a watercraft according to a preferred design. Obviously, those of ordinary skill in the watercraft art will recognize that there are other known ways of manufacturing and designing watercraft and that this invention would encompass other known ways and designs.

Figure 1:
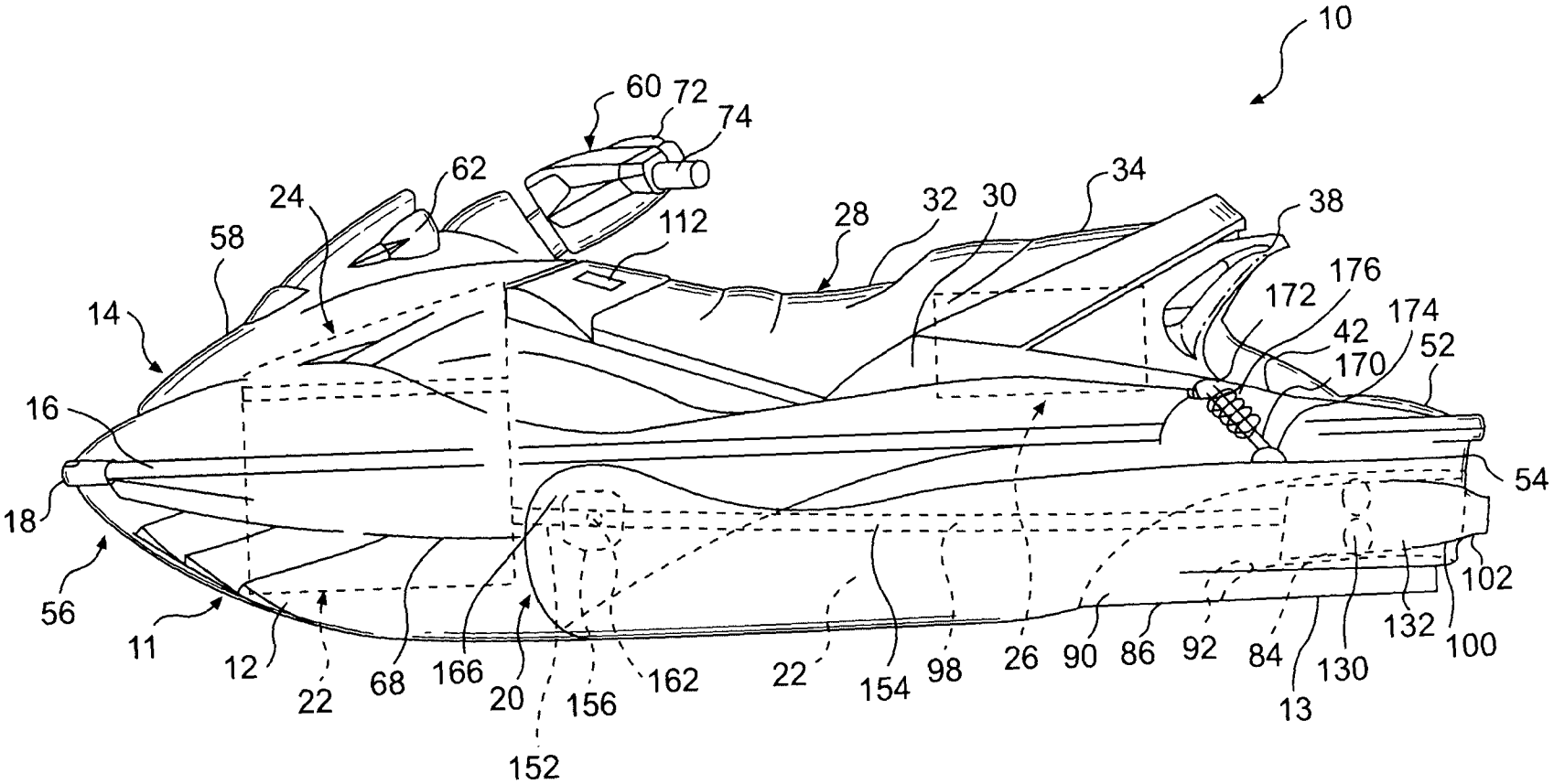
FIG. 1 illustrates a side view in partial section of a watercraft in accordance with one preferred embodiment of the invention.

The watercraft 10 of FIG. 1 is a vessel made of two main parts, including a hull 11 and a deck 14. The hull 11 buoyantly supports the watercraft 10 in the water. The hull 11, in this embodiment, comprises a bow or forward hull portion 12 and a stern or rearward hull portion 13. The deck 14 is designed to accommodate a rider and, in some watercraft, one or more passengers. The hull 11 and deck 14 are joined together at a seam 16 that joins the parts in a sealing relationship. Preferably, the seam 16 comprises a bond line formed by an adhesive. Of course, other known joining methods could be used to sealingly engage the parts together, including but not limited to thermal fusion, molding or fasteners such as rivets or screws. A bumper 18 generally covers the seam 16, which helps to prevent damage to the outer surface of the watercraft 10 when the watercraft 10 is docked, for example. The bumper 18 can extend around the bow, as shown, or around any portion or all of the seam 16.

The space between the hull 11 and the deck 14 forms a volume commonly referred to as the engine compartment 20. In this embodiment of the watercraft according to this invention, the engine compartment 20 is the space between the hull forward portion 12 and the deck 14. Shown schematically in FIG. 1, the engine compartment 20 accommodates an engine 22, as well as a muffler, tuning pipe, gas tank, electrical system (battery, electronic control unit, etc.), air box, storage bins 24, 26, and other elements required or desirable in the watercraft 10. The engine 22 is preferably immovably disposed within the engine compartment, with respect to the hull forward portion 12 and the deck 14. It should be understood that the engine 22, muffler, tuning pipe, gas tank, electric system, air box, storage bins 24, 26, and other elements may be disposed anywhere between the hull 11 and the deck 14, and that not all of them are required by the invention. For example, the engine 22 may be disposed below the straddle-type seat 28, and in the case of a four-stroke engine, a tuning pipe would not be required.

Figure 2:
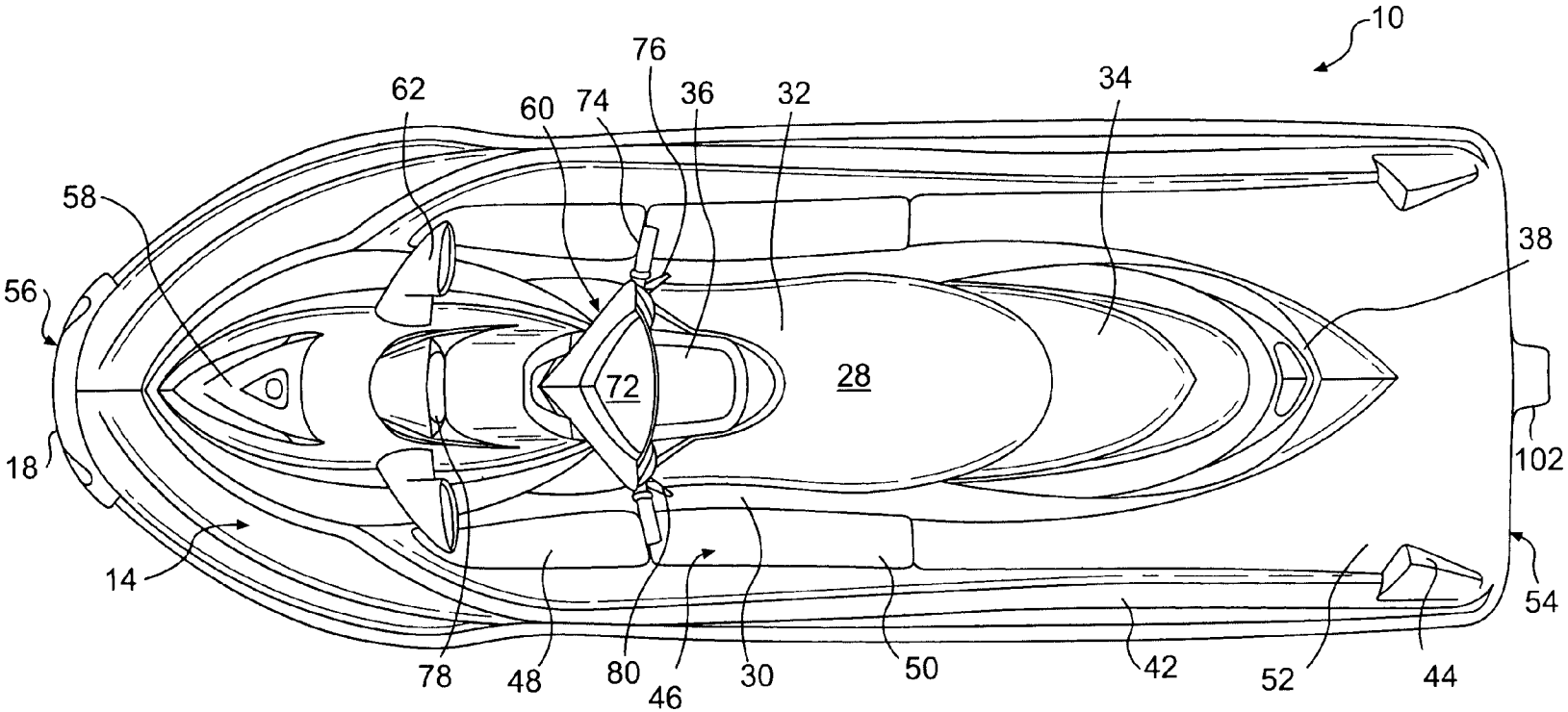
FIG. 2 is a top view of the watercraft of FIG. 1.

As seen in FIGS. 1 and 2, the deck 14 has a centrally positioned straddle-type seat 28 positioned on top of a pedestal 30 to accommodate a rider in a straddling position. The seat 28 may be sized to accommodate a single rider or sized for multiple riders. For example, as seen in FIG. 2, the seat 28 includes a first, front seat portion 32 and a rear seat portion 34 that accommodates a passenger. The seat 28 is preferably made as a cushioned or padded unit or interfitting units. The first and second seat portions 32, 34 are preferably removably attached to the pedestal 30 by a hook and tongue assembly (not shown) at the front of each seat and by a latch assembly (not shown) at the rear of each seat, or by any other known attachment mechanism. Preferably, the seat portions 32, 34 can be individually tilted or removed completely. One seat portion (in this case portion 34) can cover a removable storage box 26 (FIG. 1). A "glove compartment" or small storage box 36 may also be provided in front of the seat 28.

Figure 4:
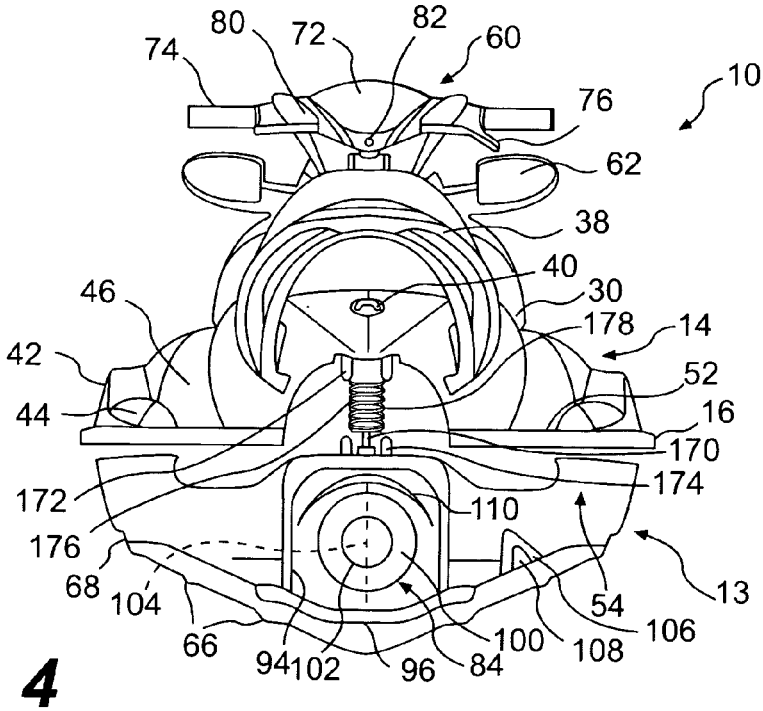
FIG. 4 is a back view of the watercraft of FIG. 1.

As seen in FIG. 4, a grab handle 38 may be provided between the pedestal 30 and the rear of the seat 28 to provide a handle onto which a passenger may hold. This arrangement is particularly convenient for a passenger seated facing backwards for spotting a water skier, for example. Beneath the handle 38, a tow hook 40 is mounted on the pedestal 30. The tow hook 40 can be used for towing a skier or floatation device, such as an inflatable water toy.

As best seen in FIGS. 2 and 4 the watercraft 10 has a pair of generally upwardly extending walls located on either side of the watercraft 10 known as gunwales or gunnels 42. The gunnels 42 help to prevent the entry of water in the footrests 46 of the watercraft 10, provide lateral support for the rider's feet, and also provide buoyancy when turning the watercraft 10, since watercraft roll slightly when turning. Towards the rear of the watercraft 10, the gunnels 42 extend inwardly to act as heel rests 44. Heel rests 44 allow a passenger riding the watercraft 10 facing towards the rear, to spot a water-skier for example, to place his or her heels on the heel rests 44, thereby providing a more stable riding position. Heel rests 44 could also be formed separate from the gunnels 42.

Located on both sides of the watercraft 10, between the pedestal 30 and the gunnels 42 are a pair of footrests 46. The footrests 46 are designed to accommodate a rider's feet in various riding positions. To this effect, the footrests 46 each have a forward portion 48 angled such that the front portion of the forward portion 48 (toward the bow of the watercraft 10) is higher, relative to a horizontal reference point, than the rear portion of the forward portion 48. The remaining portions of the footrests 46 are generally horizontal. Of course, any contour conducive to a comfortable position for the rider could be used. The footrests 46 may be covered by carpeting 50 made of a rubber-type material, for example, to provide additional comfort and traction for the feet of the rider.

A reboarding platform 52 is provided at the rear of the watercraft 10 on the deck 14 to allow the rider or a passenger to easily reboard the watercraft 10 from the water. Carpeting or some other suitable covering may cover the reboarding platform 52. A retractable ladder (not shown) may be affixed to the transom 54 to facilitate boarding the watercraft 10 from the water onto the reboarding platform 52.

Figure 3:
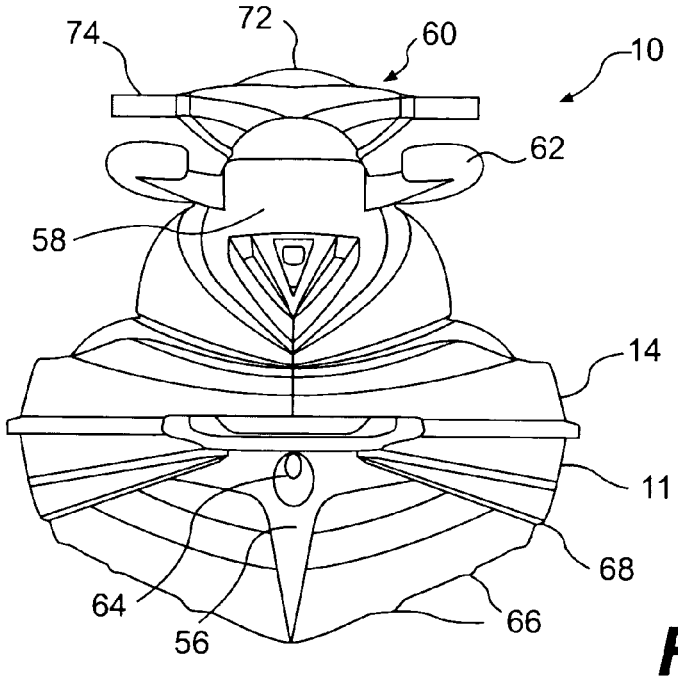
FIG. 3 is a front view of the watercraft of FIG. 1.

Referring to the bow 56 of the watercraft 10, as seen in FIGS. 2 and 3, watercraft 10 is provided with a hood 58 located forwardly of the seat 28 and a helm assembly 60. A hinge (not shown) is attached between a forward portion of the hood 58 and the deck 14 to allow hood 58 to move to an open position to provide access to the engine compartment 20. Specifically the hood 58 provides access to the front storage bin 24 (FIG. 1), if used. A latch (not shown) located at a rearward portion of hood 58 locks hood 58 into a closed position. When in the closed position, hood 58 prevents water from entering into the storage bin 24. Rearview mirrors 62 are positioned on either side of hood 58 to allow the rider to see behind. A hook 64 is located at the bow 56 of the watercraft 10. The hook 64 is used to attach the watercraft 10 to a dock when the watercraft is not in use or to attach to a winch when loading the watercraft on a trailer, for instance.

Figure 5:
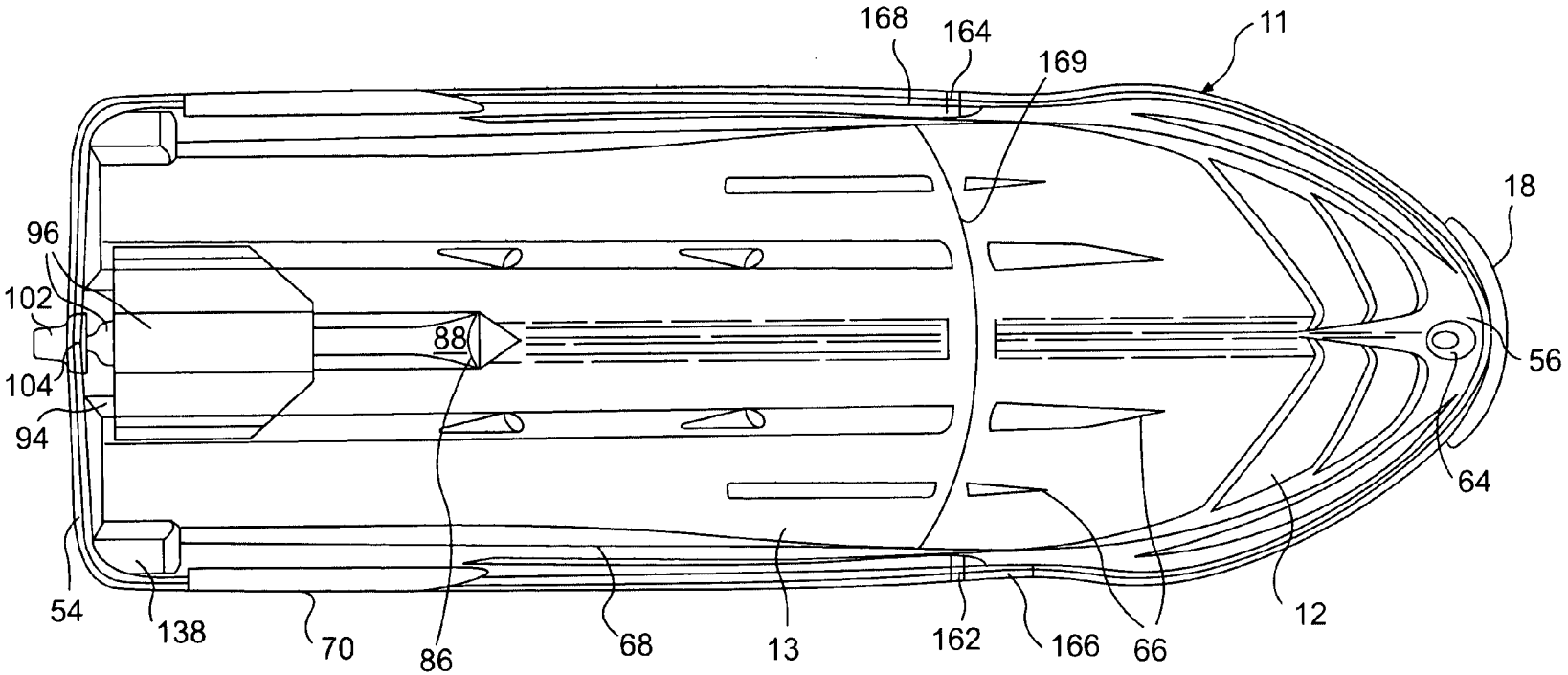
FIG. 5 is a bottom view of the hull of the watercraft of FIG. 1.

As best seen in FIGS. 3, 4, and 5, the hull 11 is provided with a combination of strakes 66 and chines 68. A strake 66 is a protruding portion of the hull 11. A chine 68 is the vertex formed where two surfaces of the hull 11 meet. The combination of strakes 66 and chines 68 provide the watercraft 10 with its riding and handling characteristics.

As best seen in FIGS. 3 and 4, the helm assembly 60 is positioned forwardly of the seat 28. The helm assembly 60 has a central helm portion 72, that may be padded, and a pair of steering handles 74, also referred to as a handle bar. One of the steering handles 74 is preferably provided with a throttle lever 76, which allows the rider to control the speed of the watercraft 10. As seen in FIG. 2, a display area or cluster 78 is located forwardly of the helm assembly 60. The display cluster 78 can be of any conventional display type, including liquid crystal displays (LCD), dials or LED (light emitting diodes). The central helm portion 72 may also have various buttons 80, which could alternatively be in the form of levers or switches, that allow the rider to modify the display data or mode (speed, engine rpm, time . . . ) on the display cluster 78 or to change a condition of the watercraft 10 such as trim (the pitch of the watercraft).

The helm assembly 60 may also be provided with a key receiving post 82, preferably located near a center of the central helm portion 72. The key receiving post 82 is adapted to receive a key (not shown) that starts the watercraft 10. As is known, the key is typically attached to a safety lanyard (not shown). It should be noted that the key receiving post 82 may be placed in any suitable location on the watercraft 10.

Returning to FIGS. 1 and 5, the watercraft 10 is generally propelled by a jet propulsion system 84, which includes a jet propulsion unit or jet pump. As known, the jet propulsion system 84 pressurizes water to create thrust. The jet propulsion system 84 is disposed within the hull rear portion 13 that is a support structure for the jet propulsion system 84. Water is first scooped from under the hull 11 through an inlet 86, which preferably has a grate (not shown in detail). The inlet grate prevents large rocks, weeds, and other debris from entering the jet propulsion system 84, which may damage the system or negatively affect performance. Water flows from the inlet 86 through a water intake ramp 88. The top portion 90 of the water intake ramp 88 is formed by the hull rear portion 13, and a ride shoe (not shown in detail) forms its bottom portion 92. Alternatively, the intake ramp 88 may be a single piece or an insert to which the jet propulsion system 84 attaches. In such cases, the intake ramp 88 and the jet propulsion system 84 are attached as a unit in a recess in the bottom of hull rear portion 12.

From the intake ramp 88, water enters the jet propulsion system 84. The jet propulsion system 84 is located in a formation in the hull rearward portion 13, referred to as the tunnel 94. The tunnel 94 is defined at the front, sides, and top by the hull rear portion 13 and is open at the transom 54. The bottom of the tunnel 94 is closed by the ride plate 96. The ride plate 96 creates a surface on which the watercraft 10 rides or planes at high speeds.

The jet propulsion system 84 includes a pump made of two main parts: an impeller 130, shown in phantom and a stator (not shown). The impeller 130, and preferably the stator, as well, are disposed within a housing 132, also shown in phantom. The impeller is coupled to the engine 22 by one or more shafts 98, such as a drive shaft and an impeller shaft. The rotation of the impeller pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet propulsion system 84, it goes through a venturi 100. Since the venturi's exit diameter is smaller than its entrance diameter, the water is accelerated further, thereby providing more thrust. A steering nozzle 102 is pivotally attached to the venturi 100 so as to pivot about a vertical axis 104. The steering nozzle 102 could also be supported at the exit of the tunnel 94 in other ways without a direct connection to the venturi 100. Alternatively, the nozzle 102 may be replaced by a rudder that redirects the pressurized water for steering.

The steering nozzle 102 is operatively connected to the helm assembly 60 preferably via a push-pull cable (not shown) such that when the helm assembly 60 is turned, the steering nozzle 102 pivots. This movement redirects the water coming from the venturi 100, so as to steer the watercraft 10 in the desired direction. Optionally, the steering nozzle 102 may be gimbaled to allow it to move around a second horizontal pivot axis (not shown). The up and down movement of the steering nozzle 102 provided by this additional pivot axis is known as trim and controls the pitch of the watercraft 10.

When the watercraft 10 is moving, its speed is measured by a speed sensor 106 attached to the transom 54 of the watercraft 10. The speed sensor 106 has a paddle wheel 108 that is turned by the flow of water. In operation, as the watercraft 10 goes faster, the paddle wheel 108 turns faster in correspondence. An electronic control unit (not shown) connected to the speed sensor 106 converts the rotational speed of the paddle wheel 108 to the speed of the watercraft 10 in kilometers or miles per hour, depending on the rider's preference. The speed sensor 106 may also be placed in the ride plate 96 or at any other suitable position. Other types of speed sensors, such as pitot tubes, and processing units could be used, as would be readily recognized by one of ordinary skill in the art.

The watercraft 10 may be provided with the ability to move in a reverse direction. With this option, a reverse gate 110, seen in FIG. 4, is used. The reverse gate 110 is pivotally attached to the sidewalls of the tunnel 94 or directly on the venturi 100 or the steering nozzle 102. To make the watercraft 102 move in a reverse direction, the rider pulls on a reverse handle 112 (FIG. 1) operatively connected to the reverse gate 110. The reverse gate 110 then pivots in front of the outlet of the steering nozzle 102 and redirects the water leaving the jet propulsion system 84 towards the front of the watercraft, thereby thrusting the watercraft 10 rearwardly. The reverse handle 112 can be located in any convenient position near the operator, for example adjacent the seat 28 as shown or on the helm 60.

In one embodiment of the invention, the hull rearward portion 13 is a support structure for the jet propulsion system 84. As is shown in FIGS. 1 and 5, the hull rearward portion 13 is movably coupled to the hull forward portion 12 through pivot pins 162 and 164. Pivot pins 162, 164 comprise one of many types of assemblies that could be used which would permit the hull rearward portion 13 to move relative to the hull forward portion 12. The pivot pins 162, 164 couple forward attachment portions 166, 168 of the hull rearward portion 13 to the hull forward portion 12. The pivot pins 162, 164 are preferably disposed in a horizontal orientation which allows vertical movement of the hull rearward portion 13 relative to the hull forward portion 12.

The hull rearward portion 13 can be coupled to the hull forward portion 12 with bearing assemblies, or any other known mechanical elements that allow relative movement between two structural elements. The hull rearward portion 13 in this embodiment is shown having a width which substantially corresponds to the width of the hull forward portion 12. FIG. 5 shows the bottom side of the hull 11. The forward edge 169 of the hull rearward portion 13 is shown extending across the width of the hull rearward portion 13. The hull rearward portion 13 can also be made in any width that would accommodate the jet propulsion system 84. The hull rearward portion 13 can be manufactured using existing known manufacturing techniques such as rotary molding or techniques used in the molding of fiberglass constructions. The hull rearward portion 13 is preferably enclosed to prohibit the entrance of water.

In the configuration shown in FIGS. 1–5, the hull rearward portion 13 is coupled to the hull forward portion 12; however, the hull rearward portion 13 could also be coupled to the deck 14. In that case, similar pivoting coupling components can be used. The forward attachment portions 166, 168 would be extended to reach and conform to the deck 14.

FIGS. 1 and 4 show a suspension element 170, which couples a rear portion of the hull rearward portion 13 to a rear portion of the deck 14. In each of these figures, a portion of the deck 14 has been broken away, for illustration purposes, to show the attachment of the suspension element 170 to the deck 14. As is shown, the suspension element 170 comprises a shock absorber in a know configuration of a resilient metallic coil spring 176 disposed around a hydraulic damper 178. However, as would be apparent to one skilled in the art, other configurations of suspension elements are also possible, including, but not limited to, resilient springs and hydraulic dampers that are used individually and are not integrated into a single shock absorber, and resilient springs such as elastomeric springs, or springs constructed from composite materials.

The suspension element 170 spans across a gap separating a rearward portion of the deck 14 from the hull rearward portion 13. The suspension element 170 allows the hull rearward portion 13 to pivot within a controlled range with respect to the hull forward portion 12 and the deck 14. The suspension element 170 is secured to mounting lugs 172 disposed on the deck 14 and mounting lugs 174 disposed on the hull rearward portion 13. As would be apparent to one skilled in the art, the suspension element 170 could be coupled to the deck 14 and the hull rearward portion 13 through a variety of structures. Additionally, although a single suspension element 170 is shown, multiple suspension elements can be used.

Figure 1A:
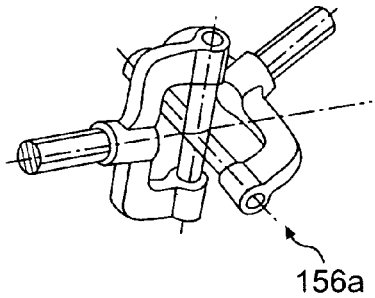
FIG. 1*a* illustrates a perspective view of an articulating coupling.
Figure 1E:
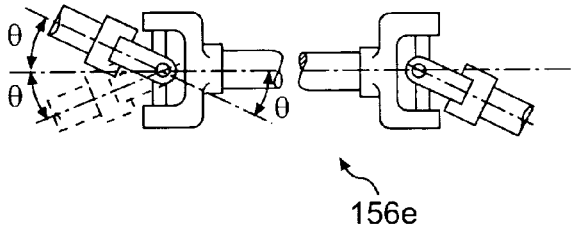
FIG. 1*e* illustrates a side view of an articulating coupling.
Figure 1B:
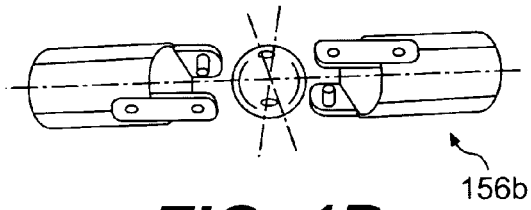
FIG. 1*b* illustrates a perspective view of an articulating coupling.
Figure 1C:
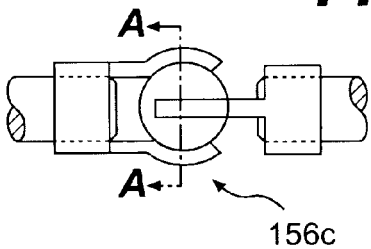
FIG. 1*c* illustrates a side view of an articulating coupling.
Figure 1D:
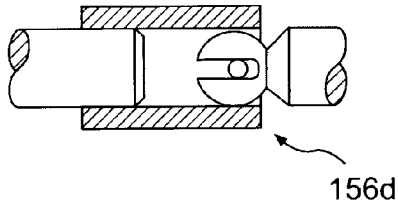
FIG. 1*d* illustrates a side view in partial section of an articulating coupling.
Figure 1F:
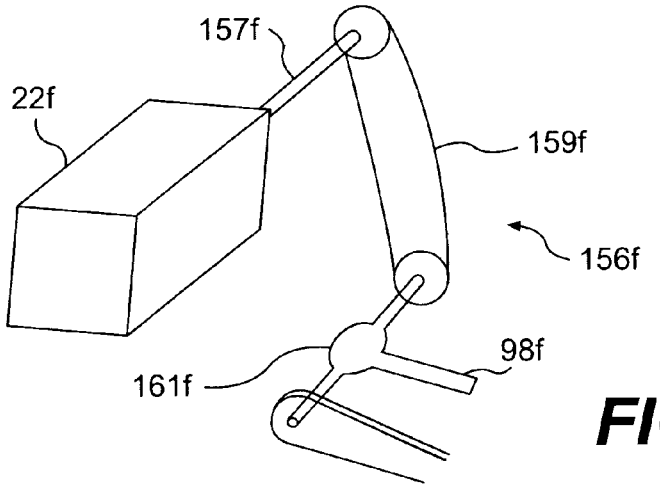
FIG. 1*f* illustrates a perspective view of a tranversely disposed engine and the combination of a differential an a pulley assembly coupled to the engine.

An articulated drive shaft 98 operatively connects the engine 22 to the jet propulsion system 84. The articulated drive shaft 98 comprises a first drive shaft section 152 coupled to the engine, a second drive shaft section 154 coupled to the jet propulsion system 84, and an articulating coupling 156 that couples the first and second drive shaft sections 152, 154. Preferably, the articulating coupling 156 comprises a known universal shaft coupling such as a Hooke's joint, such as coupling 156*a* shown in FIG. 1*a*, coupling 156*b* shown in FIG. 1B, coupling 156*c* shown in FIG. 1C, and coupling 156*d* shown in FIG. 1D. As is shown in FIG. 1E, the articulating coupling 156*e* can be a known constant velocity joint, which is made by coupling two Hooke's joints. Alternatively, as is shown in FIG. 1F, an articulating coupling 156F comprising a combination of a pivoting differential 161*f* and a pulley assembly 159*f* coupled to a transversely disposed engine output shaft 157*f* could be used to couple a transversely disposed engine 22*f* to a longitudinally disposed drive shaft 98*f*.

As is shown in phantom lines in FIG. 1, the second drive shaft section 154 comprises an impeller shaft operatively connected to the impeller 130. As would be apparent to one skilled in the art, the first drive shaft section 152 could be mechanically connected to a variety of components of the engine 22, such as a crankshaft (not shown), flywheel (not shown), or engine output shaft (not shown). The articulated drive shaft 98 permits at least vertical movement of the hull rearward portion 13 with respect to the hull forward portion 12, by allowing relative movement of the second drive shaft section 154 with respect the first drive shaft section 152. As shown, the articulating coupling 156 is preferably disposed in alignment with the pivot pins 162, 164 so that the coupling 156 pivots about the same axis as the hull rearward portion 13.

During use of the watercraft 10, the hull rearward portion 13 moves or pivots relative to the hull forward portion 12 and the deck 14 in response to forces experienced by the watercraft resulting from ambient water movement, acceleration and turning, for example. An upward relative movement of the hull rearward portion 13 with respect to the deck 14 causes a compression stage of the suspension element 170. The suspension element 170 will rebound to a normal position after the compression stage. As known, a hydraulic damper 174 slows the rate at which the suspension element 170 can compress during the compression stage and extend during a rebound stage. As is also known, the spring 176 of the suspension element 170 forces the suspension element 170 to extend during the rebound stage, which follows the compression stage.

The suspension element 170 allows the watercraft 10 to absorb an impact with a wave by allowing the force applied to the hull 11 to be absorbed by the suspension element 170. Accordingly, the absorption of the impact minimizes the chance that the jet propulsion system 84 will become disengaged from the water. The suspension element 170 also absorbs shocks that would otherwise be transferred to the rider and any passengers of the watercraft. The suspension element 170 allows the pivoting hull rearward portion 13 to move up or down to follow the surface of the water, thus reducing the likelihood that the jet propulsion system 84 will become disengaged from the water.

Figure 6:
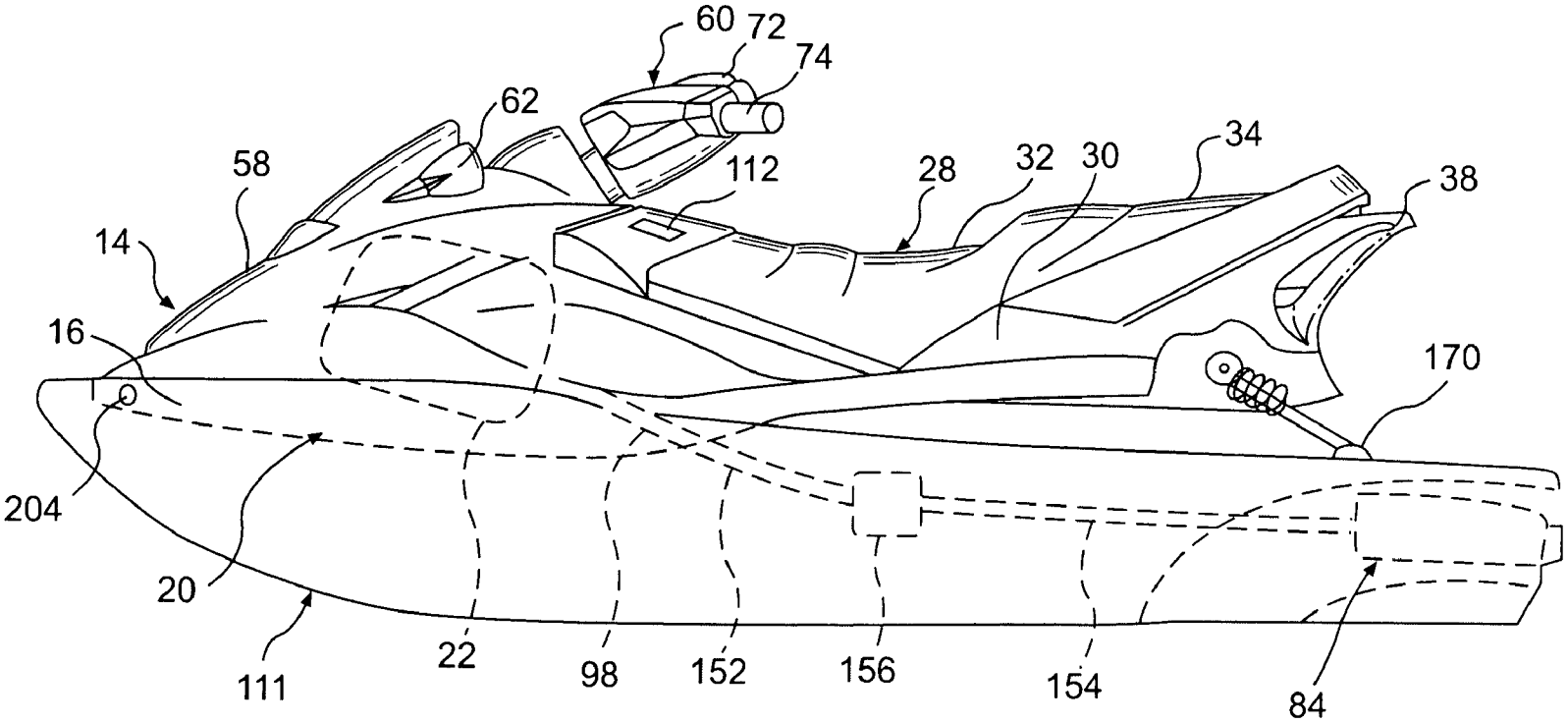
FIG. 6 illustrates a side view in partial section of a watercraft in accordance with another preferred embodiment of the invention.
Figure 7:
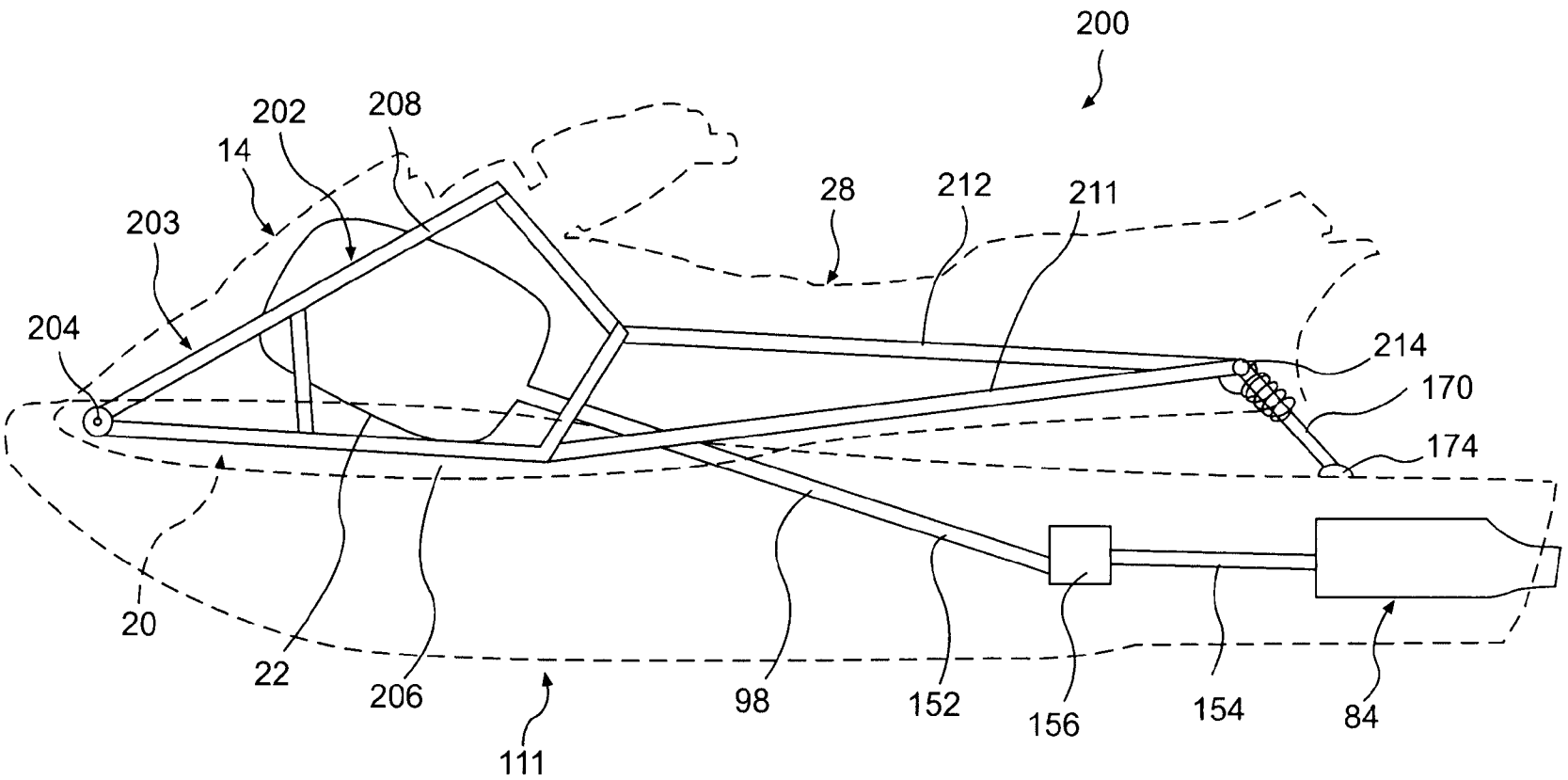
FIG. 7 is a second side view of the watercraft of FIG. 6 with the hull and deck shown in phantom.

FIGS. 6 and 7 show another embodiment 200 of the watercraft of the present invention. In this embodiment 200, the entire hull 111 is movably coupled to the deck 14. The hull 111 is preferably manufactured using existing known manufacturing techniques such as rotary molding or techniques used in the molding of fiberglass constructions. The hull 111 is preferably enclosed to prohibit the entrance of water.

As was the case in the embodiment shown in FIGS. 1–5, an articulated drive shaft 98 operatively connects the engine 22 to the jet propulsion system 84 in this embodiment of the watercraft 200. FIG. 6 shows the engine 22, articulated drive shaft 98, and jet propulsion system 84 in phantom. FIG. 7 shows the deck 14 and hull 111 in phantom to reveal the watercraft components within the internal engine compartment 20. The deck 14 comprises an internal frame assembly 202 which is fixed to the deck 14 within the engine compartment 20. The internal frame assembly 202 may be fixed to the deck 14 through brackets 203, such as is shown, or through mechanical fasteners or adhesives. The frame assembly 202 could also be molded integrally with the deck 14.

The internal frame assembly 202 provides a structure having the necessary strength to support the engine 22 by the deck 14. The engine 22 is supported on the internal frame assembly 202 and, thus, is substantially immovably coupled to the deck 14. The internal frame assembly 202 includes a forward pivot element 204, which is the attachment point for the hull 111. Accordingly, the forward pivot element 204 is the structure through which the forward portion of the hull 111 is coupled to the deck 14.

The internal frame assembly 202 includes lower frame element 206 and upper frame element 208, both of which extend rearwardly from the forward pivot element 204. Rear deck frame elements 211 and 212 are disposed within the deck 14 underneath a straddle seat 28. Mounting lugs 214, disposed at the rear portions of the frame elements 211 and 212, are used to secure the suspension element 170 to the deck 14.

In use, the entire hull 111 of the watercraft 200 moves in a pivoting manner about the deck 14. During the compression stage of the suspension element 170, the rear portion of the hull 111 moves closer to the rear portion of the deck 14 causing compression of the suspension element 170 and pivoting of the hull 111 about the pivot element 204 in a counterclockwise direction. In the rebound stage, the rear portion of the hull 111 moves in a clockwise direction away from the rear portion of the deck 14. The suspension element 170 elongates during the rebound stage.

The first drive shaft section 152 extends rigidly from the engine 22 into the cavity of the hull 111. The jet propulsion unit 84 is fixedly supported in the hull 111. The articulating coupling 156 allows the first drive shaft section 152 to pivot with respect to the second drive shaft section 154. Thus, the jet propulsion unit 84 can move with the hull 111, while the engine 22 remains fixed in the deck 14.

Figure 8:
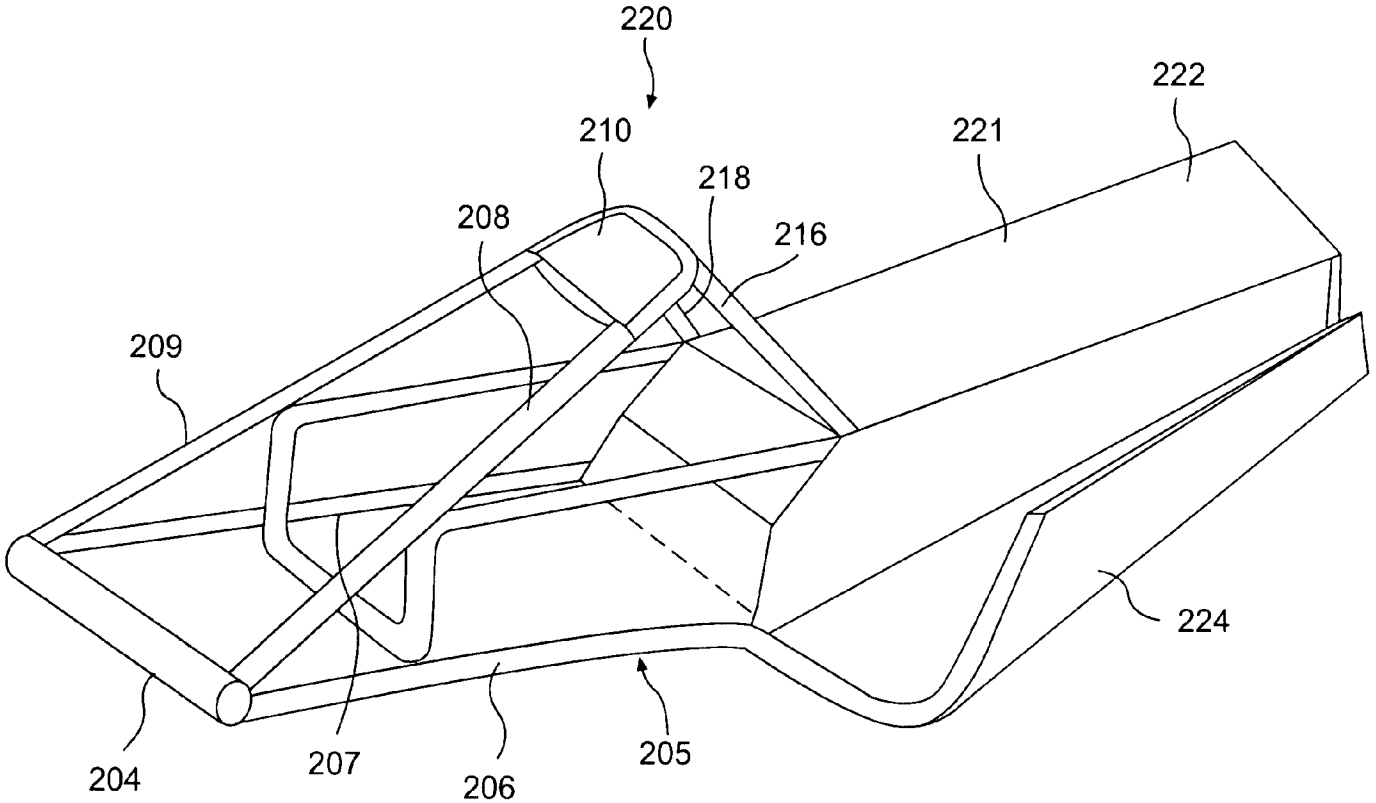
FIG. 8 is a perspective view of a internal frame and chassis of another preferred embodiment of the invention.

FIG. 8 shows another embodiment of the internal frame assembly 220. In this embodiment, a sheet metal chassis 221 is coupled to the frame elements 206, 207, 216, and 218 through the use of mechanical fasteners or welding. The sheet metal chassis 221 replaces the frame elements 211 and 212 which were shown in the previous embodiment 200 in FIG. 7. The sheet metal chassis 221 has a main channel 222 as well as outward extensions 224. The main channel 222 functions as a seat 28 support, and the extensions 224 help to rigidify the assembly while forming gunnels 42. FIG. 8 also shows the entire triangulated forward portion of the internal frame assembly 220 and a steering assembly mounting panel 210, which is secured to the frame elements 208, 209, 216, and 218. This frame 220 is similar to a snowmobile frame.

Figure 9:
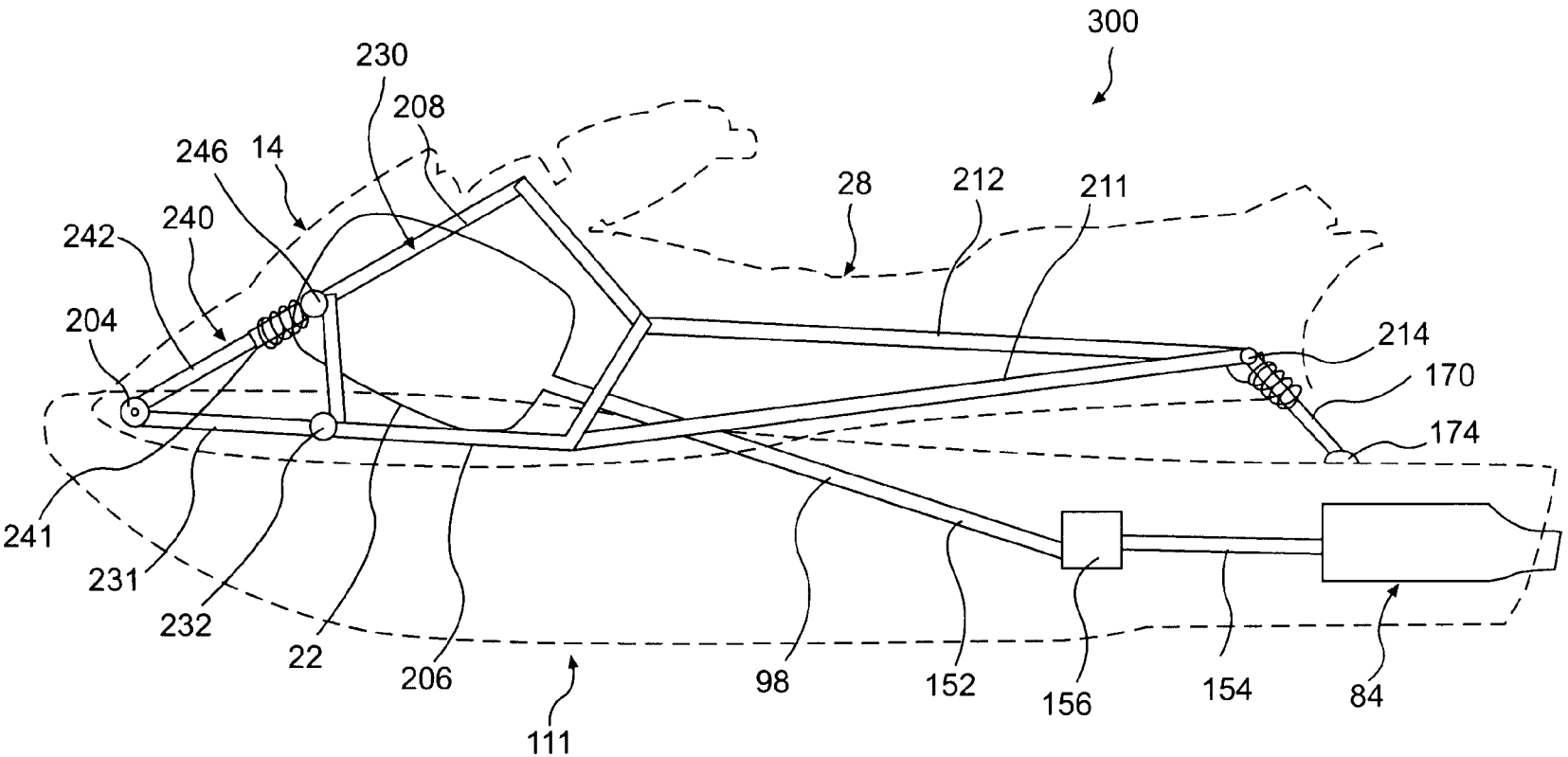
FIG. 9 illustrates a side view watercraft in accordance with another preferred embodiment of the invention with the hull and deck shown in phantom.

FIG. 9 shows another embodiment of the watercraft 300 of the present invention. This embodiment of the watercraft 300 includes an internal frame assembly 230, which is a modified configuration of the internal frame assembly 202, previously shown in FIGS. 7 and 8. Specifically, this embodiment of the internal frame assembly 230 includes an additional suspension element 240 which is disposed at a forward location on the internal frame assembly between a first frame location, which is attachment knuckle 246, and a second frame location, which is the pivot element 204. As was described in the previous embodiment, the pivot element 204 is coupled to the hull 111. Accordingly, the suspension element 240 is disposed between a forward portion of the hull 111 and a forward portion of the deck 14. The suspension element 240, like the previously described suspension element 170 is preferably a known shock absorber comprising a resilient spring 241 (in this embodiment a metallic coil spring) and a hydraulic damper 242. The suspension element 240 complements the first suspension element 170, which is disposed between a rearward portion of the hull 111 and a rearward portion of the deck 14. However, it is within the scope of the invention that the suspension element 240 could be the only suspension element used in a watercraft. Although a single suspension element 240 is shown in FIG. 9, preferably a second suspension element (not shown) would be disposed between the pivot element 204 and frame element 209 (shown previously in FIG. 8) on the other side of the hull. The suspension elements 240 would work together but would also allow the deck 14 to rotate or twist slightly with respect to the longitudinal axis of the hull 111.

Preferably, the front suspension element 170 is stiff, with a short travel arm, while the rear suspension element 240 is softer, with a long travel arm.

In use, this embodiment of the watercraft 300 is configured to allow the hull 111 to move relative to the deck 14 at both the rearward and forward portions of the watercraft 300. Upon the impact of the watercraft 300 with a wave, the watercraft hull 111 will move upwardly with respect to the deck 14 in a manner that absorbs the shock of the impact. As the hull 111 moves upwardly with respect to the deck 14, the suspension elements 170 and 240 both compress. The location on the hull 111 where the hull 11 impacts the wave will determine the extent to which each of the suspension elements 170 and 240 compress. This is the compression stage of the suspension elements 170 and 240. During this compression stage the hull 111 moves against the spring force of each of the suspension elements 170 and 240 causing the springs 176, 241 of each of the suspension elements 170 and 240 to compress. The springs 176, 241 of each of the suspension elements 170 and 240 are responsible for the hull 111 moving away from the deck 14 during the rebound stage. The hydraulic dampers 174, 242 slow the rate at which the compression and rebound stages will occur. By absorbing the impact of the watercraft with a wave, the movement of the hull 111 with respect to the deck 14 via compression of the suspension element 170 helps the jet propulsion system 84, which is disposed within the hull 111, to maintain contact with the water. By absorbing the impact of the watercraft with the wave, the movement of the hull 111 with respect to the deck 14 via compression of the suspension elements 240, 170 decreases the shock experienced by the rider and passengers of the watercraft.

Many, if not most, of the heavy watercraft components (e.g., the engine 22, fuel tank, oil tank, battery, internal frame assembly 230, etc.) are supported by and move with the deck 14 rather than the hull 111. Consequently, the deck 14, heavy watercraft components, and rider(s) have a larger inertia than the hull 111. The lighter hull 111 will therefore tend to react (move) under the force of the suspension elements 170, 240 faster than the deck 14 in response to the presence and absence of impact forces with waves and the water's surface. The low-inertia, fast reaction time of the hull 111 and jet propulsion system 84 facilitates more continuous contact between the water and the jet propulsion system 84, which improves the power and handling of the jet propulsion system 84 and watercraft 300. Conversely, the heavier deck 14 resists sudden movements that might otherwise result from impacts with waves and therefore provides a gentler, more comfortable ride for the rider(s). While the positioning of heavy watercraft components on the watercraft's deck instead of the hull is only discussed with respect to this embodiment, the principle applies equally well to all of the embodiments of the present invention. To the extent possible, heavy watercraft components should be mounted to the same watercraft section (e.g., the deck portion) that the rider(s) are supported on. Conversely, the portion of the watercraft that moves with jet propulsion system should be as light as possible.

Figure 10:
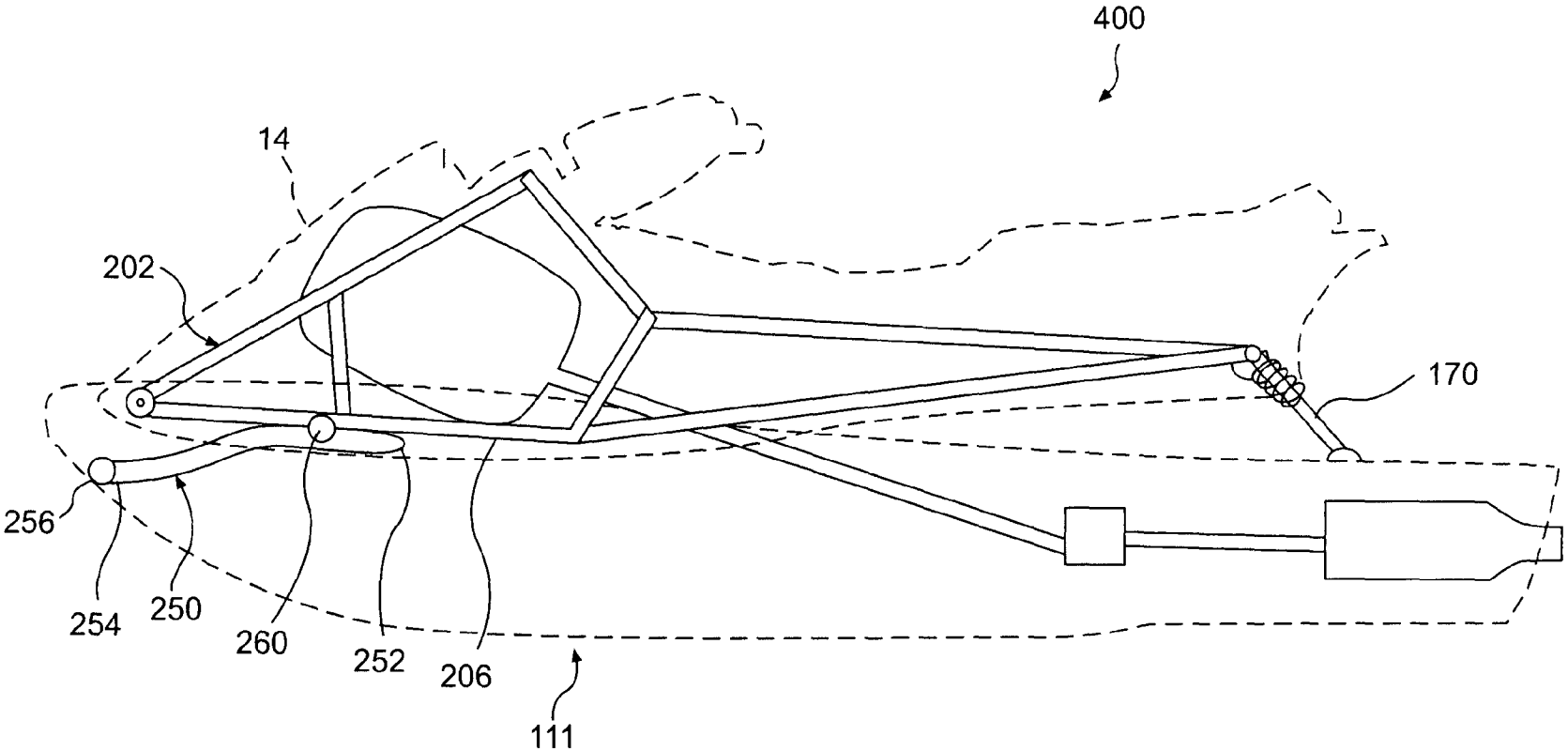
FIG. 10 illustrates a side view of a watercraft in accordance with another preferred embodiment of the invention with the hull and deck shown in phantom.

FIG. 10 shows another embodiment of the watercraft 400. In this embodiment of the watercraft 400, another configuration of a suspension element 250 is disposed between the forward portion of the hull 111 and the forward portion of the deck 14. The suspension element comprises a flexible beam 250. The flexible beam 250 is preferably constructed from composite materials such as carbon fiber and epoxy resin or plastics. However, the flexible beam 250 could be manufactured from a variety of materials that have the desired modulus of elasticity and damping characteristics. Metals such as titanium could also be used in the construction of the flexible beam 250. The flexible beam 250 is preferably coupled to the hull 111 through a bracket 256. Alternatively, the flexible beam 250 could be movably coupled to the hull through a spring biased pivot such as a torsion spring (not shown) or other suitable structure. The flexible beam 250 includes a forward end 254 and a rearward end 252. The bracket 256 is disposed proximate to the flexible beam forward end 254. The flexible beam 250 is coupled to the frame element 206 of the internal frame 202 at junction 260. The junction 260 would preferably comprise either a movable or immovable coupling which would join the flexible beam 250 to the internal frame 202. Although a single flexible beam 250 is shown in FIG. 10, it is preferable that a second suspension element (not shown) would be disposed between hull 111 and frame element 207 (shown previously in FIG. 8). The flexible beam 250 could also be coupled to elements of the internal frame 202 other than the frame elements 206 and 207, if desired.

In use, the embodiment of the watercraft 400 functions in a similar manner to the watercraft 300 shown previously in FIG. 9. However, upon the impact of the watercraft 400 with a wave the front of the hull 111 will move toward the deck causing an elastic downward deflection of the flexible beam 250. This is the compression stage of the flexible beam 250. The downward deflection of the flexible beam 250 during the compression stage is followed by a rebound stage where the flexible beam 250 moves upwardly with respect to the hull 111. Although a separate damper mechanism is not shown with the flexible beam 250, a damper mechanism such as a known hydraulic damper could be used in combination with the flexible beam 250.

Although various specific configurations of the internal frame assembly have been shown in FIGS. 6 through 10, other frame configurations are possible within the scope of the invention. The internal frame assembly could be manufactured from a variety of materials such as steel or aluminum tubing, or from steel or aluminum sheet metal.

Figure 11:
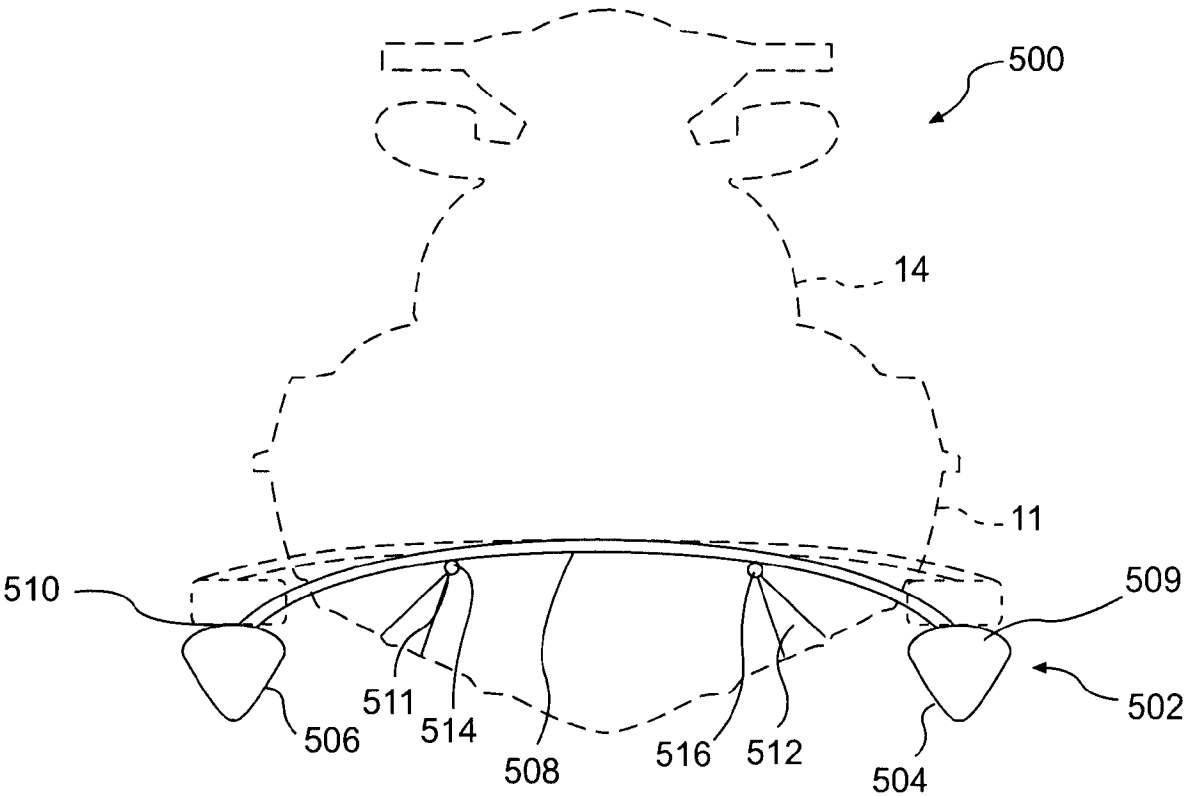
FIG. 11 illustrates a front view of a watercraft in accordance with another preferred embodiment of the invention with the hull and deck shown in phantom.
Figure 12:
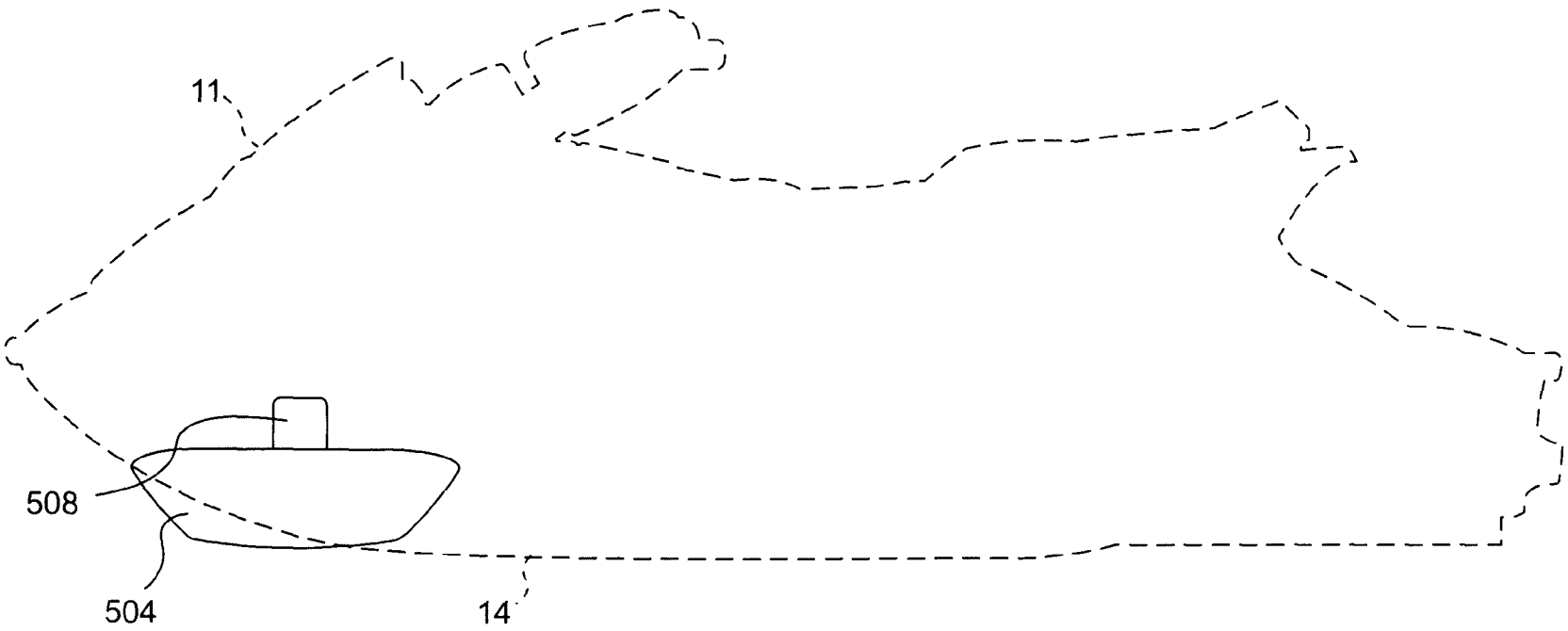
FIG. 12 is a side view of the watercraft of FIG. 11.

FIGS. 11 and 12 show another embodiment of the watercraft 500. In this embodiment of the watercraft 500, a ski assembly 502 is coupled to the bow of the watercraft 500. The deck 14 and hull 11 are shown in phantom to reveal the ski assembly 502. The ski assembly 502 comprises a port ski 504 and a starboard ski 506. The skis 504, 506 are disposed laterally with respect to a longitudinal centerline of the watercraft, which splits the watercraft into port and starboard sides. The skis 504, 506 preferably comprises an enclosed structure which is buoyant. The skis 504, 506 can be manufactured from a variety of materials such as plastic, fiberglass, and metal using a variety of manufacturing known techniques used in the construction of watercraft. The skis 504, 506 are coupled to a flexible beam 508. The flexible beam 508 is a suspension element disposed between each ski and the bow. The flexible beam 508 preferably has an arch shape, as is shown, however other shapes are contemplated within the scope of the invention. The flexible beam 508 could be manufactured from a variety of materials such as plastic, composite, and metals.

In this embodiment, a single flexible beam 508 is used to couple the skis 504, 506 to the hull of the watercraft 500. The flexible beam 508 has a first end 509 and a second end 510, both of which are disposed outside the hull 11, while the remainder of the flexible beam 508 is disposed within the hull 11. The flexible beam 508 is coupled to the hull 11 through brackets 511, 512. Mechanical fasteners 512, 514 or other known devices couple the flexible beam 508 to the brackets 511, 512. Ski 504 is coupled to the flexible beam first end 509, and ski 510 is coupled to the flexible beam second end 510. The ski assembly 502 could be attached to the hull 11 through devices other than brackets 511, 512, for example through the use of an internal frame (not shown) secured to the hull 11. Seals (not shown) are preferably used to seal the locations on the hull 11 where the ends of the flexible beam 508 extend through the hull 11.

Figure 13:
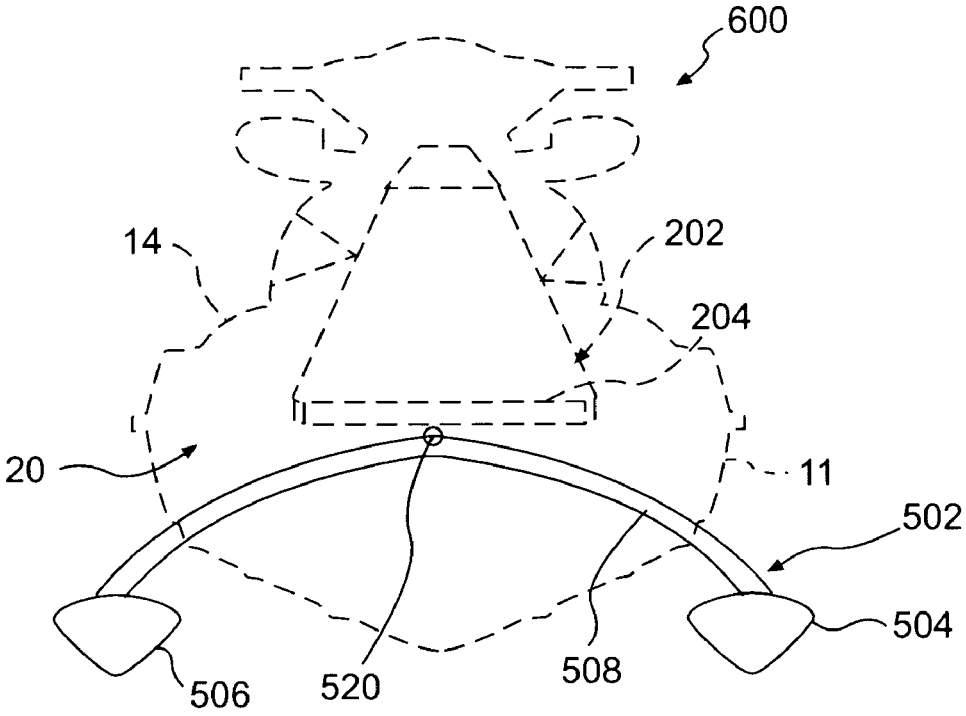
FIG. 13 illustrates a front view of a watercraft in accordance with another preferred embodiment of the invention with the hull and deck shown in phantom.

FIG. 13 shows another embodiment of the watercraft 600. In this embodiment of the watercraft 500, the ski assembly 502 is coupled to the internal frame 202 disposed within the engine compartment 20. The deck 14 and hull 11 are again shown in phantom to reveal the ski assembly 502. As was previously described, the internal frame 202 is coupled to the deck 14. Accordingly, the ski assembly 502 in this embodiment is coupled to the deck 14 at location at the bow of the watercraft 500. The attachment of the ski assembly 502 to the internal frame 202 could be accomplished though a known mechanical fastener 520 or bracket assembly. In this embodiment, the flexible beam 508 is shown coupled to the forward pivot element 204. The ski assembly 502 could also be secured to other locations on the internal frame 202 as well as to other locations on the deck 14.

Figure 14:
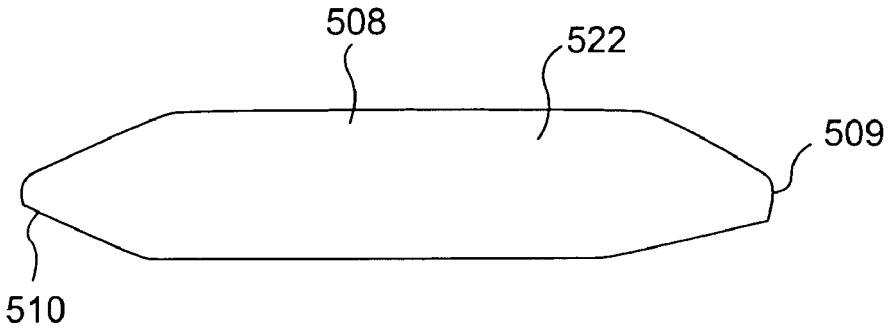
FIG. 14 illustrates a top view of a flexible beam in accordance with the preferred embodiments of the invention shown in FIGS. 11–13.

FIG. 14 is a top view of a preferred embodiment of the flexible beam 508. As shown, the flexible beam 508 has a tapered configuration. A center portion 522 has a width greater than the first and second ends 509, 510. The flexibility of the first and second ends 509, 510 is greater than the flexibility of the center portion 522. This configuration could also be used for beam 250 of the embodiment of FIGS. 11 and 12.

Figure 15:
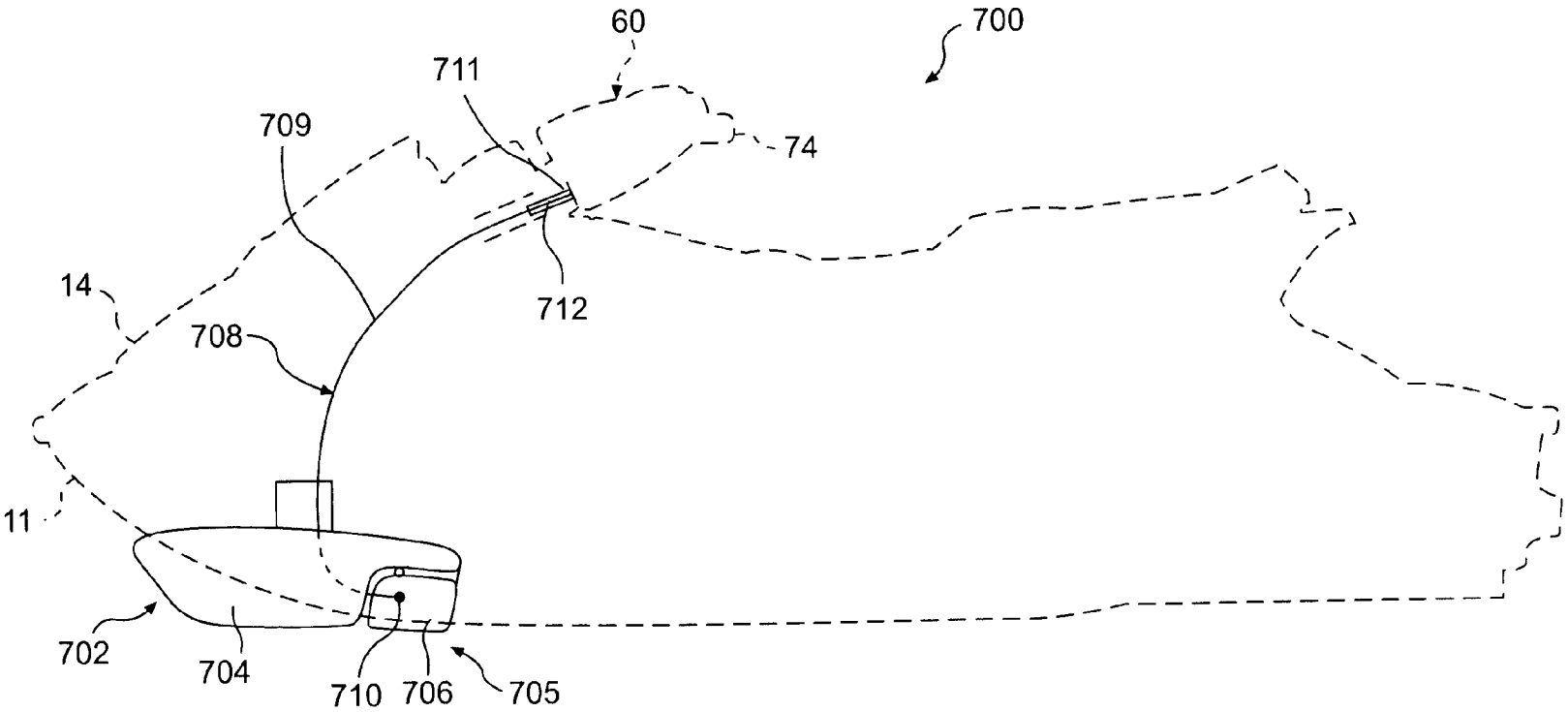
FIG. 15 illustrates a side view of a watercraft in accordance with another preferred embodiment of the invention with the hull and deck shown in phantom.

FIG. 15 shows yet another embodiment of the watercraft 700. In this embodiment of the watercraft 700, the port ski 704 of the ski assembly 702 includes a rudder assembly 705. The deck 14 and hull 11 are again shown in phantom to reveal the ski assembly 702. Although only the port ski 704 of the ski assembly 702 is shown, it is understood that the ski assembly 702 would preferably include a second starboard ski (not shown) similar to the port ski 704. The rudder assembly 705 comprises a rudder 706 which is coupled to the helm assembly 60 so that movements of the handle bar 74 are translated to the rudder 706. An actuator mechanism 708 couples the assembly 705 to the helm assembly 60. The actuator mechanism 708 comprises a push-pull cable 709 having a first end 710 coupled to the rudder 706 and a second end 711 coupled to the helm assembly 60. The push-pull cable 709 preferably extends through a housing 712, such as is partially shown in FIG. 15. The rudder 706 is connected to the ski 704 through a pivot 713.

In use, the rotation of the handle bar 74 causes the push-pull cable 709 to move correspondingly. The movement of the push-pull cable 709 moves the rudder 706. Although a single push-pull cable 709 actuation mechanism 708 is shown, it would be apparent to one skilled in the art that a dual cable actuation mechanism could also have been used. Mechanical actuation mechanisms other than cable actuation mechanisms, and electromechanical actuation mechanisms such as motors or solenoids could also have been used to actuate movement of the rudder 706. The actuator mechanism could be electrically controlled and implemented also.

Figure 16:
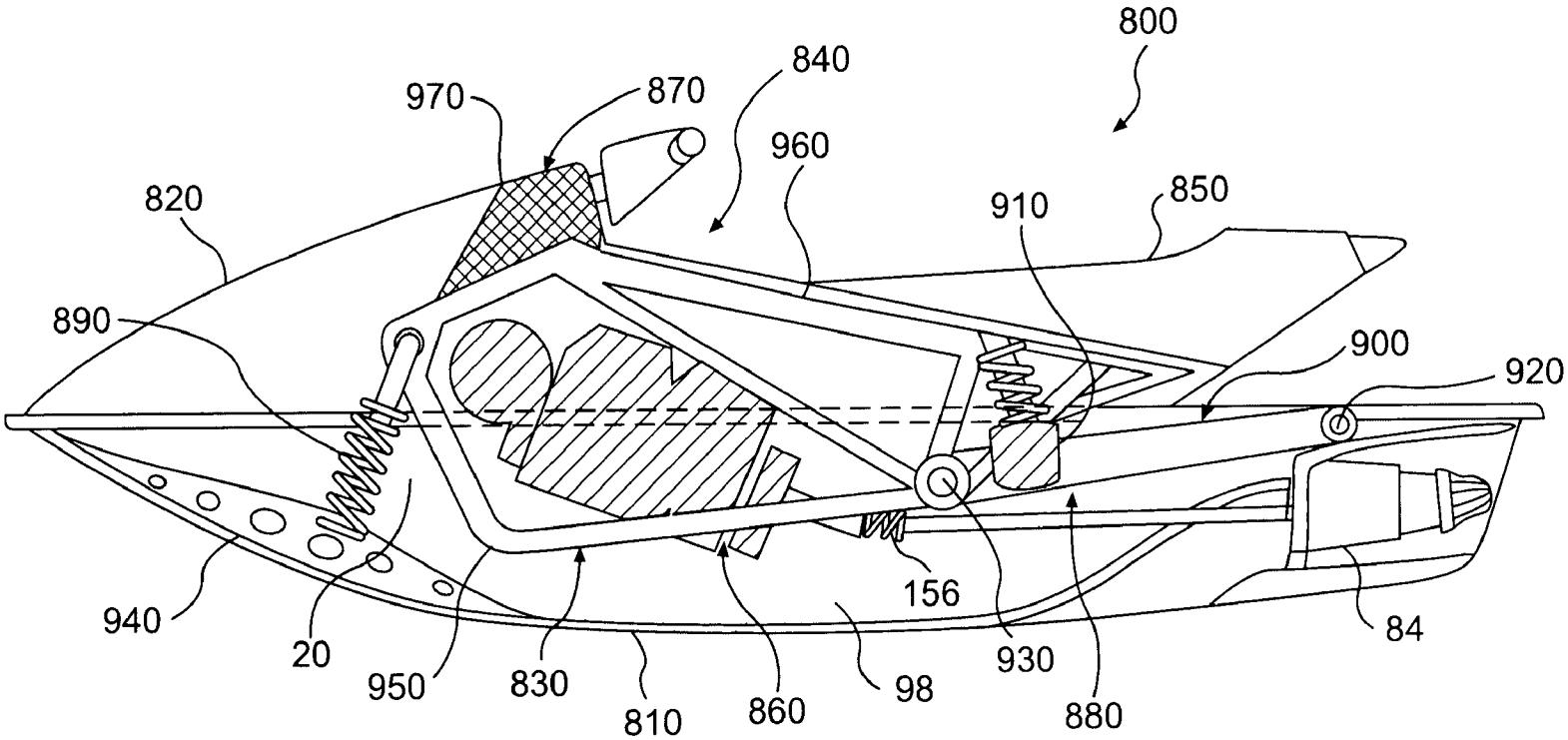
FIG. 16 illustrates a side view in partial section of a watercraft in accordance with another preferred embodiment of the invention.

FIG. 16 illustrates another embodiment 800 of the watercraft of the present invention. In this embodiment 800, the entire hull 810 and a forward hood (or fairing or upper front portion of the hull) 820 are movably coupled to a deck 840. The deck 840 includes an internal frame assembly 830, a straddle-type seat 850, the engine 860, and a helm assembly 870.

The hull 810 and hood 820 are preferably manufactured using known manufacturing techniques and are preferably enclosed to prohibit the entrance of water and to define the engine compartment 20. Unlike in the previous embodiments in which the hood 820 (or forward portion of the deck) moved with the deck 14, the hood 820 is rigidly mounted to the forward portion of the hull 810 and moves with the hull 810. The hood 820 need not be openable and may be integrally formed with the hull 810.

The internal frame assembly 830 of the deck 840 is movably coupled to an aft portion of the hull 810 via a rear swing arm suspension system 880 and to a forward portion of the hull 810 via a forward shock absorber 890. The rear swing arm suspension system comprises a swing arm 900 and a rear shock absorber 910. A rearward end of the swing arm 900 is coupled to an aft portion of the hull 810 for relative pivotal movement about a laterally extending axis 920. The hull 810 is preferably reinforced at the pivotal connection so as to spread out the load exerted on the hull 810 by the swing arm 900. A forward end of the swing arm 900 is coupled to the internal frame assembly 830 for relative pivotal movement about a laterally extending axis 930. The rear shock absorber 910 extends between the swing arm 900 and a rearward portion of the internal frame assembly 830. As illustrated in FIG. 16, the rear shock absorber 910 acts in compression and biases the frame assembly 830 counterclockwise relative to the swing arm 900 about the axis 930.

The rear swing arm suspension system 880 could be modified in a variety of ways without departing from the scope of the present invention. For example, the rear shock absorber 910 could extend between different portions of the rear swing arm 900 and internal frame assembly 830 and act in tension so as to bias the internal frame assembly 830 clockwise relative to the rear swing arm 900 (as viewed in FIG. 16).

One end of the forward shock absorber 890 pivotally couples to a forward portion of the hull 810. The hull 810 preferably includes reinforcing members (e.g., plates, frames, thicker fiberglass, etc.) 940 at the pivotal connection formed between the hull 810 and the front shock absorber 890 to spread out the load exerted on the hull 810 by the front shock absorber 890. The other end of the front shock absorber 890 pivotally connects to a forward portion of the internal frame 830. As illustrated in FIG. 16, the forward shock absorber 890 acts in compression to bias the frame assembly 830 clockwise relative to the hull 810 about the axis 920. However, the watercraft 800 could alternatively be designed such that the front shock absorber 890 is positioned to act in tension to pull the internal frame assembly 830 upwardly relative to the hull 810.

As in the previous embodiments, the shock absorbers 890, 910 may comprise any combination of spring elements and damping elements.

The internal frame assembly 830 preferably comprises a plurality of interconnected tubular members that form a box-shaped forward frame 950 and a seat support frame 960. As illustrated in FIG. 16, the engine 860 is rigidly mounted in the box-shaped frame 950. The helm assembly 870 is also mounted to an upper portion of the box-shaped frame 950. The seat support frame 960 is disposed above and to the rear of the box-shaped frame 950. The straddle-type seat 850 is mounted to the seat support frame 960. The tubular frame design of the internal frame assembly 830 provides the deck 840 with sufficient strength and rigidity to support the engine 860, the helm assembly 870, the seat 850, and one or more passengers.

While the illustrated internal frame assembly 830 comprises a tubular construction with a specific shape, the internal frame assembly 830 could comprise a variety of alternative constructions and shapes without departing from the scope of the present invention. For example, the internal frame assembly 830 could be replaced by a reinforced fiberglass deck or a stamped piece of sheet metal such as aluminum.

The watercraft 800 may also be modified by combining the swing arm 900 and the internal frame assembly 830 into a single rigid internal frame construction. In such an alternative embodiment, the rear shock absorber 910 could be eliminated such that the composite internal frame assembly pivots about the axis 920.

As in the embodiment shown in FIGS. 1–5, an articulated drive shaft 98 with an articulating coupling 156 and an extendable coupling 965 operatively connect the engine 860 to the jet propulsion system 84 in this embodiment of the watercraft 800. The extendable coupling 965 enables the one end of the coupling 965 to telescope axially relative to the other end while still transferring rotation from the engine 860 to the jet propulsion system 84. The extendable coupling 965 may comprise any known extendable coupling such as a splined coupling (see FIG. 19A). The extendable coupling 965 and the articulating coupling 156 enable the drive shaft 98 to transfer rotation from the engine 860 to the jet propulsion system 84 despite two degrees of relative movement between the jet propulsion system 84 and the engine 860.

Because the helm assembly 870 moves with the internal frame assembly 830 and the other components of the deck 840 while the hood 820 moves with the hull 810, a joint 970 is formed between the helm assembly 870 and the hood 820. A flexible material, such as rubber, preferably covers the joint 970 to discourage water and/or other debris from entering the engine compartment 20 through the joint 970. A similar watertight seal is preferably included over the other joints between the hull 810 and the deck 840.

A lower deck portion may extend underneath the engine 860 and seal against the deck 840 to form a substantially sealed engine compartment between the lower deck portion and the deck 840. Because the engine 860 and other watercraft components that are supported by the deck 840 and/or internal frame assembly 830 are disposed within the engine compartment, the hull 810 need not sealingly engage the deck 840. Openings may be provided in the transom of the hull 810 to allow water that accumulates in the hull 810 to escape when the watercraft accelerates.

The helm assembly 870 includes handlebars operatively connected to the jet propulsion unit 84 via cables or other control mechanisms. A plurality of displays may also be disposed on the helm assembly 870.

In use, the deck 840 moves relative to the hull 810 and hood 820. The swing arm 900 and shock absorbers 890, 910 combine to bias the deck 840 (and specifically the internal frame assembly 830) upwardly relative to the hull 810. When the watercraft 800 impacts a wave, both shock absorbers 890, 910 compress so that the deck 840 moves downwardly relative to the hull 810 to absorb the impact. As would be appreciated by one of ordinary skill in the art, the predetermined spring constants, damping parameters, and positioning of the shock absorbers 890, 910 will determine whether the deck 840 additionally rolls clockwise or counterclockwise as well (as viewed in FIG. 16). Specifically, the deck 840 will roll counterclockwise as the shock absorbers 890, 910 compress if the forces exerted on the deck 840 cause the frame assembly 830 to pivot counterclockwise relative to the swing arm 900 more than the swing arm 900 pivots clockwise relative to the hull 810. The shock absorbers 890, 910, swing arm 900, and deck 840 are preferably designed to balance the translational and rotational movement of the internal frame assembly 830 during wave impact to keep the watercraft 800 in contact with the water and provide the most comfortable ride for the rider and/or passengers.

The suspension system of the watercraft 800 may be modified in a variety of ways without departing from the scope of the present invention. For example, the relative positions of the front shock absorber 890 and rear swing arm suspension system 880 may be switched such that the front shock absorber 890 is disposed at the rearward end of the internal frame assembly 830 and the rear swing arm suspension system 880 is disposed at the forward end of the internal frame assembly 830. Such an embodiment would function in a similar manner to the embodiment illustrated in FIG. 9.

Figure 18:
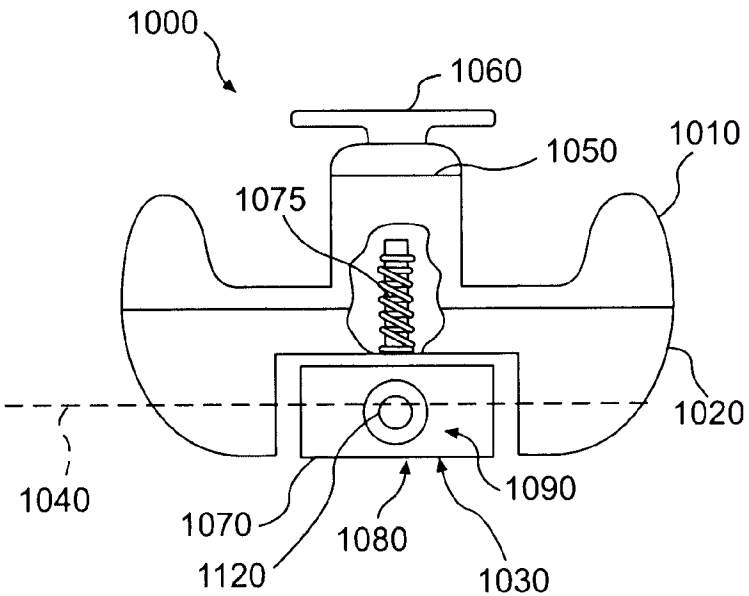
FIG. 18 illustrates a rear view of the watercraft of FIG. 17.
Figure 17:
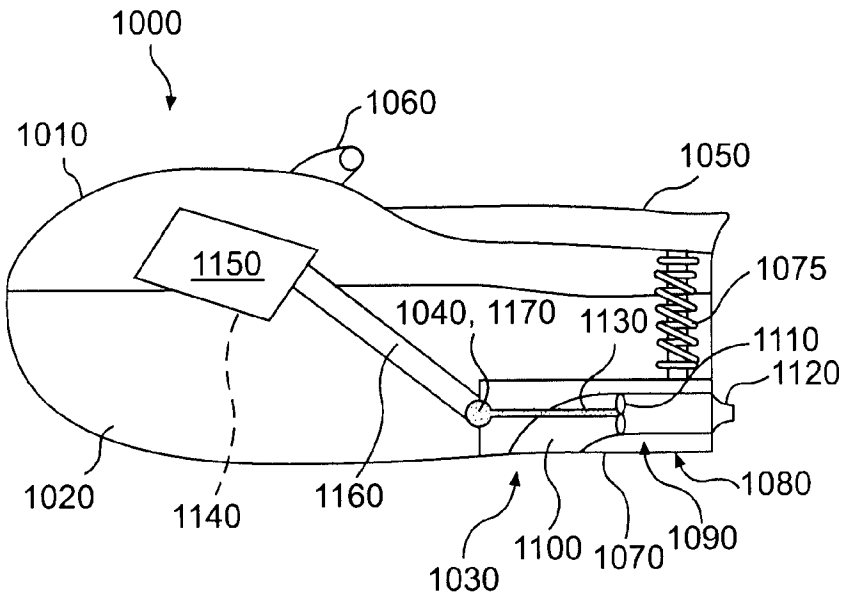
FIG. 17 illustrates a side view is partial section of a watercraft in accordance with another preferred embodiment of the invention.

FIGS. 17 and 18 illustrate another embodiment 1000 of a watercraft of the present invention. The watercraft 1000 includes a deck 1010 and a hull 1020, and a jet propulsion assembly 1030. The deck 1010 and hull 1020 are joined together. The jet propulsion assembly 1030 connects to a rearward portion of the hull 1020 for relative pivotal movement about a laterally-extending jet propulsion assembly axis 1040. However, it is to be understood that the jet propulsion assembly 1040 could alternatively and/or additionally pivotally connect to the deck 1010 without deviating from the scope of the present invention.

A straddle-type seat 1050 and a helm assembly 1060 are supported by the deck 1010.

The jet propulsion assembly 1030 comprises a frame 1070 with a forward portion that pivotally connects to the hull 1020 at the axis 1040. A suspension element 1075 extends between the deck 1010 and the jet propulsion assembly 1030 to urge the rearward end of the jet propulsion assembly 1030 downwardly about axis 1040 relative to the hull 1020. The suspension element 1075 could alternatively extend between the hull 1020 and the jet propulsion assembly 1030 without deviating from the scope of the present invention.

The jet propulsion assembly also includes a ride plate 1080 mounted underneath the frame 1070. A lower surface of the ride plate 1080 is preferably generally level with a lower surface of the hull so that the lower surface of the watercraft 1000 is generally streamlined. A jet propulsion system 1090 is supported by the frame 1070. The jet propulsion system includes a water passageway 1100, an impeller 1110 rotatably mounted within the water passageway 1100, a steering nozzle 1120 disposed at a rear end of the water passageway and operatively connected to the helm assembly 1060, and a jet propulsion system drive shaft 1130 rotatably engaged with the impeller 1110.

As illustrated in FIG. 17, an engine compartment 1140 is defined between the deck 1010 and the hull 1020. An engine 1150 is supported by the hull 1020 within the engine compartment 1140. An output shaft 1160 (or drive shaft) of the engine 1150 operatively connects to the driveshaft 1130 of the jet propulsion system 1090 to power the jet propulsion system 1090. An articulating coupling 1170 operatively connects the engine output shaft 1160 to the drive shaft 1130. The articulating coupling 1170 may be identical to or similar to any one of the previously-described couplings 156*a*, 156*b*, 156*c*, 156*d*, 156*e* (see FIGS. 1A–1E). The articulating coupling 1170 is disposed at or near the axis 1040 such that the jet propulsion assembly 1030 and the drive shaft 1130 may simultaneously pivot relative to the hull 1020 and engine output shaft 1160, respectively, while allowing the engine output shaft 1160 to rotationally drive the drive shaft 1130.

During higher speed operation of the watercraft 1000, most, if not all, contact between the watercraft 1000 and the body of water occurs at the ride plate 1080 of the jet propulsion assembly 1030. Because the jet propulsion assembly 1030 is lighter than the pivotally connected remainder of the watercraft 1000, the jet propulsion assembly 1030 quickly pivots relative to the heavier hull 1020 in response to wave impacts and the force of the suspension element 1075 to increase the contact between the jet propulsion assembly 1030 and the water. The increased contact improves the handling and power of the watercraft 1000.

Figure 19A:
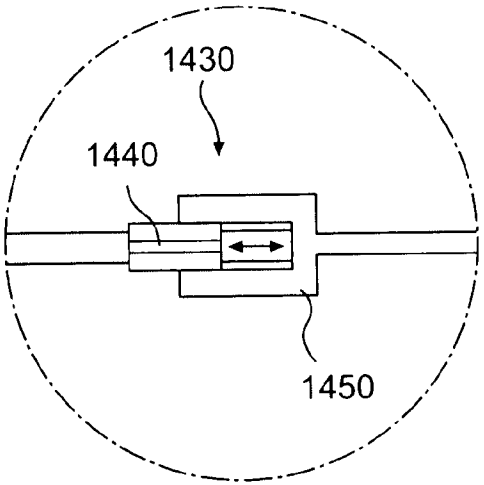
FIG. 19A illustrates a detailed view of FIG. 19.
Figure 19:
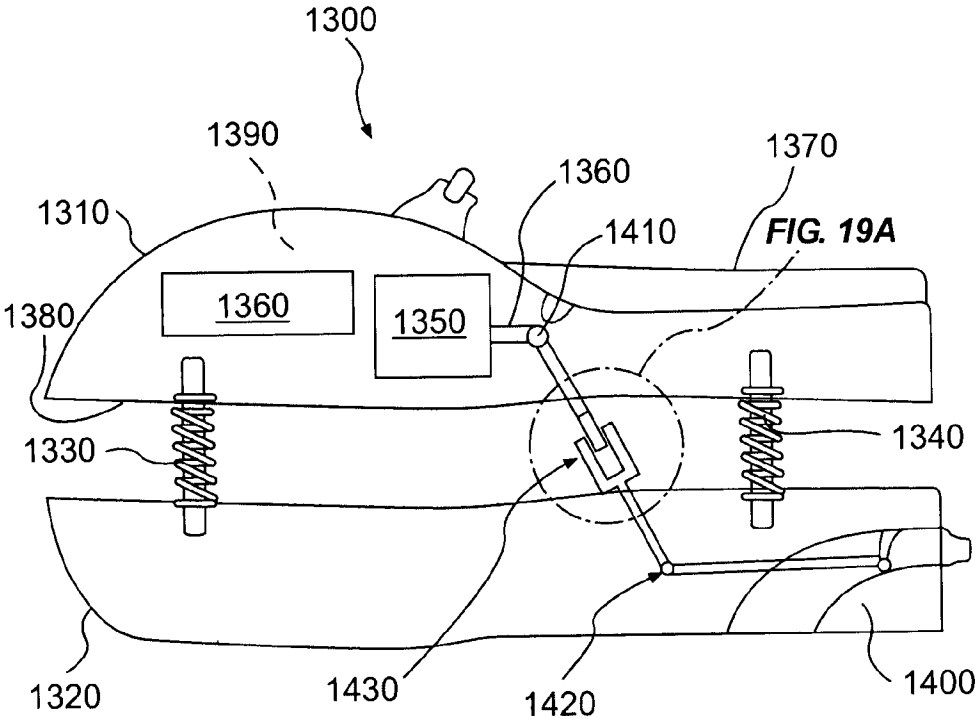
FIG. 19 illustrates a side view is partial section of a watercraft in accordance with another preferred embodiment of the invention.

FIGS. 19 and 19A illustrate another embodiment 1300 of a watercraft of the present invention. The watercraft 1300 includes a deck 1310 and a hull 1320. The deck 1310 and hull 1320 are movably coupled to each other via front and back suspension elements 1330, 1340. The suspension elements 1330, 1340 are preferably mounted to the deck 1310 and hull 1320 in accordance with the teachings of U.S. Pat. No. 5,603,281, FIGS. 20A and 20B and col. 8. U.S. Pat. No. 5,603,281 is incorporated by reference herein in its entirety. An engine 1350 is supported by the deck 1310 and includes a drive shaft 1360. A fuel tank 1370, battery (not shown), an oil tank (not shown), and a straddle-type seat 1370 are also supported by the deck 1310.

A lower deck portion 1380 sealingly engages the deck 1310 to define a substantially enclosed engine compartment 1390 in which the engine 1350, fuel tank 1360, battery, and oil tank are disposed. The suspension elements 1330, 1340 and engine drive shaft 1360 extend through the lower deck portion 1380. Alternatively, the lower deck portion 1380 may be omitted altogether. In such an embodiment, the deck 1310 and hull 1320 would be sealingly coupled together to define an engine compartment therebetween. A collapsible, flexible, waterproof membrane such as is described in U.S. Pat. No. 5,603,281 may be used to seal the deck 1310 to the hull 1320 and enable the deck 1310 and hull 1320 to move relative to each other.

A jet propulsion system 1400 is supported by the hull 1320 and operatively connected to the engine drive shaft 1360. The engine drive shaft 1360 includes two articulating couplings 1410, 1420 and an extendable coupling 1430. As illustrated in FIG. 19A, the extendable coupling 1430 includes a splined shaft 1440 that fits into a splined bore of a second shaft 1450. One of the shafts 1440, 1450 operatively connects to the engine 1350 while the other operatively connects to the jet propulsion system 1400. The shafts 1440, 1450 may axially slide relative to each other. However, the splined connection ensures that rotation is transferred between the shafts 1440, 1450. Together, the articulating couplings 1410, 1420 and extendable coupling 1430 allow the engine 1350 to transfer power to the jet propulsion system 140 via the drive shaft 1360 despite translation and/or pivotal movement of the engine 1360 relative to the jet propulsion system 1400 during actuation of the suspension elements 1330, 1340.

The embodiments described herein are not mutually exclusive and can be used in combination. For example, it is contemplated that any one of the suspended hull mechanisms shown in FIGS. 1–10 and 16–19 could be used in combination with any one of the suspended ski mechanisms of FIGS. 11–15. Of course, any one of these features could be used alone also.

Although the above description contains specific examples of the present invention, these should not be construed as limiting the scope of the invention but as merely providing illustrations of some of the presently preferred embodiments of this invention. Thus, the scope of the invention should be determined by the appended claims and their legal equivalents rather than by the examples given.

Additionally, as noted previously, this invention is not limited to PWC. For example, the deck suspension system disclosed herein may also be useful in small boats or other floatation devices other than those defined as personal watercrafts, such as boats having a stern drive propulsion system.

What is claimed is:

1. A watercraft comprising:

a deck;

a hull moveably coupled to the deck;

a steering handle operatively connected to the deck;

an engine substantially immovably coupled to the deck;

a jet propulsion unit supported by the hull, including an inlet for taking in water, an impeller assembly for generating a pressurized stream of water, an outlet for discharging the pressurized stream of water, and a movable element positioned at the outlet for selectively directing the pressurized stream of water, wherein the movable element is operatively connected to the steering handle and directs the pressurized stream of water based on signals from the steering handle; and a suspension system suspending the deck on the hull and configured so as to be only operative in a vertical plane containing the longitudinal axis of the vehicle.

2. The watercraft of claim 1, further comprising an engine compartment disposed between the forward portion and the deck, the engine being disposed within the engine compartment.

3. The watercraft of claim 1, further comprising an articulated drive shaft operatively connecting the engine to the jet propulsion system, wherein the drive shaft comprises a first drive shaft section coupled to the engine, a second drive shaft section coupled to the jet propulsion system, and an articulating coupling that couples the first and second drive shaft sections.

4. The watercraft of claim 1, wherein the suspension element is disposed between a rearward portion of the hull and a rearward portion of the deck.

5. The watercraft of claim 1, wherein a forward portion of the hull is pivotally coupled to a forward portion of the deck.

6. The watercraft of claim 1, wherein the suspension system is disposed between a forward portion of the hull and a forward portion of the deck.

7. The watercraft of claim 1, wherein:

the suspension element comprises a first suspension system, which is disposed between a rearward portion of the hull and a rearward portion of the deck; and the watercraft further comprises a second suspension system disposed between a forward portion of the hull and a forward portion of the deck.

8. The watercraft of claim 7, wherein the second suspension system comprises a flexible beam coupled to the forward portion of the hull and the forward portion of the deck.

9. The watercraft of claim 7, wherein the first suspension system further comprising:

a swing arm having first and second spaced pivot points, the first pivot point being pivotally connected to the rearward portion of the hull, the second pivot point being pivotally connected to the rearward portion of the deck; and a first shock absorber extending between the swing arm and the deck.

10. The watercraft of claim 1, further comprising an internal frame coupled to the deck at a position beneath the deck, wherein the engine is supported by the internal frame.

11. The watercraft of claim 1, further comprising a drive shaft operatively connecting the engine to the jet propulsion system, wherein the drive shaft comprises a first drive shaft section coupled to the engine, a second drive shaft section coupled to the jet propulsion system, and an extendable coupling that couples the first and second drive shaft sections.

12. The watercraft of claim 1, further comprising a gas tank substantially immovably coupled to the deck.

* * * * *